US010535924B2

(12) United States Patent
Yoshida

(10) Patent No.: US 10,535,924 B2
(45) Date of Patent: Jan. 14, 2020

(54) ANTENNA DEVICE

(71) Applicant: NEC Corporation, Tokyo (JP)

(72) Inventor: Takahide Yoshida, Tokyo (JP)

(73) Assignee: NEC CORPORATION, Minato-ku, Tokyo (JP)

( * ) Notice: Subject to any disclaimer, the term of this patent is extended or adjusted under 35 U.S.C. 154(b) by 375 days.

(21) Appl. No.: 15/535,798

(22) PCT Filed: Dec. 21, 2015

(86) PCT No.: PCT/JP2015/006339
§ 371 (c)(1),
(2) Date: Oct. 3, 2017

(87) PCT Pub. No.: WO2016/103670
PCT Pub. Date: Jun. 30, 2016

(65) Prior Publication Data

US 2018/0151953 A1 May 31, 2018

(30) Foreign Application Priority Data

Dec. 24, 2014 (JP) ..... 2014-260897

(51) Int. Cl.
*H01Q 3/36* (2006.01)
*H01Q 3/26* (2006.01)
(Continued)

(52) U.S. Cl.
CPC ..... *H01Q 3/36* (2013.01); *H01Q 3/2694* (2013.01); *H01Q 21/22* (2013.01); *H01P 1/184* (2013.01);
(Continued)

(58) Field of Classification Search
CPC ..... H01Q 1/246; H01Q 3/26; H01Q 21/061; H01Q 3/24; H01Q 3/36; H01Q 21/28;
(Continued)

(56) References Cited

U.S. PATENT DOCUMENTS 4,348,681 A 9/1982 McVeigh et al.
5,940,030 A * 8/1999 Hampel ..... H01Q 21/0006 333/161
(Continued)

FOREIGN PATENT DOCUMENTS

JP 42-13563 B1 8/1967
JP 2-20908 A 1/1990
(Continued)

OTHER PUBLICATIONS

International Search Report of PCT/JP2015/006339, dated Mar. 15, 2016. [PCT/ISA/210].
(Continued)

*Primary Examiner* — Olumide Ajibade Akonai
(74) *Attorney, Agent, or Firm* — Sughrue Mion, PLLC

(57) ABSTRACT

An object of the present invention is to provide an antenna device having a wide beam scan range with reduced loss. The antenna device according to one aspect of the present invention includes: a first phase shifter, a second phase shifter, and a third phase shifter; a first connection part that electrically connects between the first phase shifter and the second phase shifter directly in series; a second connection part that electrically connects between the second phase shifter and the third phase shifter directly in series; and a power feed part that feeds electric power to the first phase shifter to the third phase shifter, wherein the first phase shifter and the second phase shifter, and the second phase shifter and the third phase shifter respectively have characteristic impedance being discontinuous with respect to each other at the first connection part and the second connection part.

16 Claims, 22 Drawing Sheets

(51) Int. Cl.

| | |
|---|---|
| ***H01Q 21/22*** | (2006.01) |
| ***H01Q 1/24*** | (2006.01) |
| ***H01Q 3/34*** | (2006.01) |
| ***H01Q 21/00*** | (2006.01) |
| ***H01P 1/18*** | (2006.01) |

(52) U.S. Cl.
CPC ..... *H01Q 1/246* (2013.01); *H01Q 3/34* (2013.01); *H01Q 21/0006* (2013.01)

(58) Field of Classification Search
CPC .. H01P 1/183; H01P 1/18; H01P 1/182; H01P 1/184; H03H 7/20
See application file for complete search history.

(56) References Cited

U.S. PATENT DOCUMENTS 6,097,267 A * 8/2000 Hampel ..... H01P 1/184 333/128
6,667,714 B1 * 12/2003 Solondz ..... H01Q 1/246 342/368
7,352,325 B1 * 4/2008 Floyd ..... H01Q 3/30 342/372
7,907,100 B2 3/2011 Mortazawi et al.
2010/0238067 A1 9/2010 Nakabayashi et al.

FOREIGN PATENT DOCUMENTS

JP 2000-91832 A 3/2000
JP 2005-236389 A 9/2005
JP 3970222 B2 9/2007
JP 2010-220008 A 9/2010

OTHER PUBLICATIONS

Written Opinion of PCT/JP2015/006339, dated Mar. 15, 2016. [PCT/ISA/237].

* cited by examiner

ANTENNA DEVICE

CROSS REFERENCE TO RELATED APPLICATIONS

This application is a National Stage of International Application No. PCT/JP2015/006339 filed Dec. 21, 2015, claiming priority based on Japanese Patent Application No. 2014-260897, filed Dec. 24, 2014, the contents of all of which are incorporated herein by reference in their entirety.

TECHNICAL FIELD

The present invention relates to an antenna device for wireless communication over a wide range.

BACKGROUND ART

A phased array antenna is known as an antenna for scanning a directional beam without physically moving an antenna. The phased array antenna is composed of a plurality of antenna elements. Each of the antenna elements is connected with a phase shifter. Each phase shifter alters a phase of a radio wave emitted from corresponding one of the connected antenna elements. By the phase shifter controlling a phase shift amount of the antenna element, the phased array antenna is able to scan a directional beam. For example, PTL 1 discloses a directivity-controllable array antenna. In addition, PTL 2 discloses a phase-tunable antenna feed network.

PTL 3 discloses a configuration of a phased array antenna in which each antenna element is connected with a variable capacitor. The phased array antenna described in PTL 3 alters a phase of a radio wave emitted from the antenna element by varying a value of the variable capacitor. By thus controlling a phase shift amount of each of the antenna elements, the phased array antenna described in PTL 3 scans a beam.

PTL 4 discloses a configuration of a phased array antenna equipped with two or more element groups, each of which includes two or more antenna elements having variable reactance elements. The phased array antenna described in PTL 4 alters a phase of the antenna element by varying a value of a variable reactance. By thus controlling a phase shift amount of each of the antenna elements, the phased array antenna described in PTL 4 scans a beam.

CITATION LIST

Patent Literature

[PTL 1] Japanese Unexamined Patent Application Publication No. 2005-236389

[PTL 2] Japanese Unexamined Patent Application Publication No. 2000-091832

[PTL 3] Specification of U.S. Pat. No. 7,907,100

[PTL 4] Japanese Patent Publication No. 3970222

SUMMARY OF INVENTION

Technical Problem

The phased array antennas described in PTLs 3 and 4 scan a beam by varying a capacitance value of a variable reactance element. However, when the capacitance value of these antennas is large, the variable reactance element has increased return loss in high-frequency bands. For this reason, the phased array antennas described in PTLs 3 and 4 have a problem of limited availability for only low-frequency bands. In addition, for the same reason, the phased array antennas described in PTLs 3 and 4 have to place a limit on the capacitance value for lower loss. At this time, a phase shift amount of each antenna element decreases, which results in a problem of a narrower beam scan range.

An object of the present invention is to provide a variable directivity antenna device having a wide beam scan range with reduced loss.

Solution to Problem

A variable directivity antenna device according to one aspect of the present invention includes: a first phase shifter, a second phase shifter, and a third phase shifter; a first connection part that electrically connects between the first phase shifter and the second phase shifter directly in series; a second connection part that electrically connects between the second phase shifter and the third phase shifter directly in series; and a power feed part that feeds electric power to the first phase shifter to the third phase shifter, wherein the first phase shifter and the second phase shifter, and the second phase shifter and the third phase shifter respectively have characteristic impedance being discontinuous with respect to each other at the first connection part and the second connection part.

Advantageous Effects of Invention

A first advantageous effect of the present invention resides in that a variable directivity antenna device can perform beam scanning for a wide range with low loss.

DESCRIPTION OF EMBODIMENTS

Figure 1:
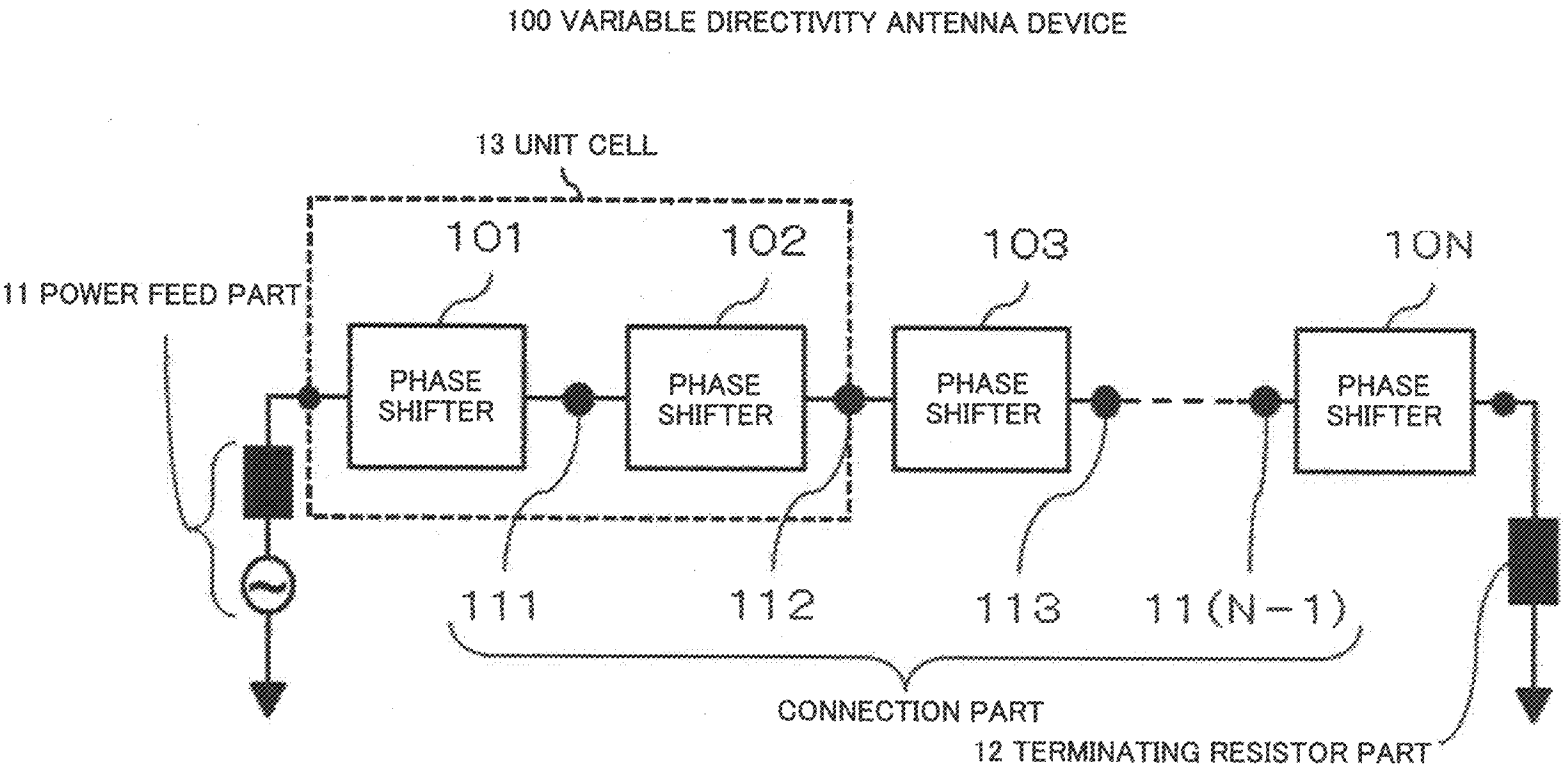
FIG. 1 is a block diagram illustrating a configuration of a variable directivity antenna device according to a first exemplary embodiment of the present invention.

Next, modes for carrying out the present invention will be described in detail with reference to the drawings. Note that a component including the same function is assigned with the same reference symbol throughout the respective drawings and respective exemplary embodiments described herein. Note that a direction of an arrow in the drawing indicates an example, but is not intended to limit a direction of a signal between blocks.

[First Exemplary Embodiment]

A first exemplary embodiment of a variable directivity antenna device (antenna device) according to the present invention will be described in detail with reference to the drawings.

First, with reference to FIG. 1, a configuration example according to the first exemplary embodiment will be described. FIG. 1 is a block diagram illustrating a configuration example of a variable directivity antenna device 100 according to the first exemplary embodiment. The variable directivity antenna device 100 according to the first exemplary embodiment includes phase shifters 101, 102, 103, . . . , and 10N, connection parts 111, 112, . . . , and 11(N−1), a power feed part 11, and a terminating resistor part 12.

Figure 2:
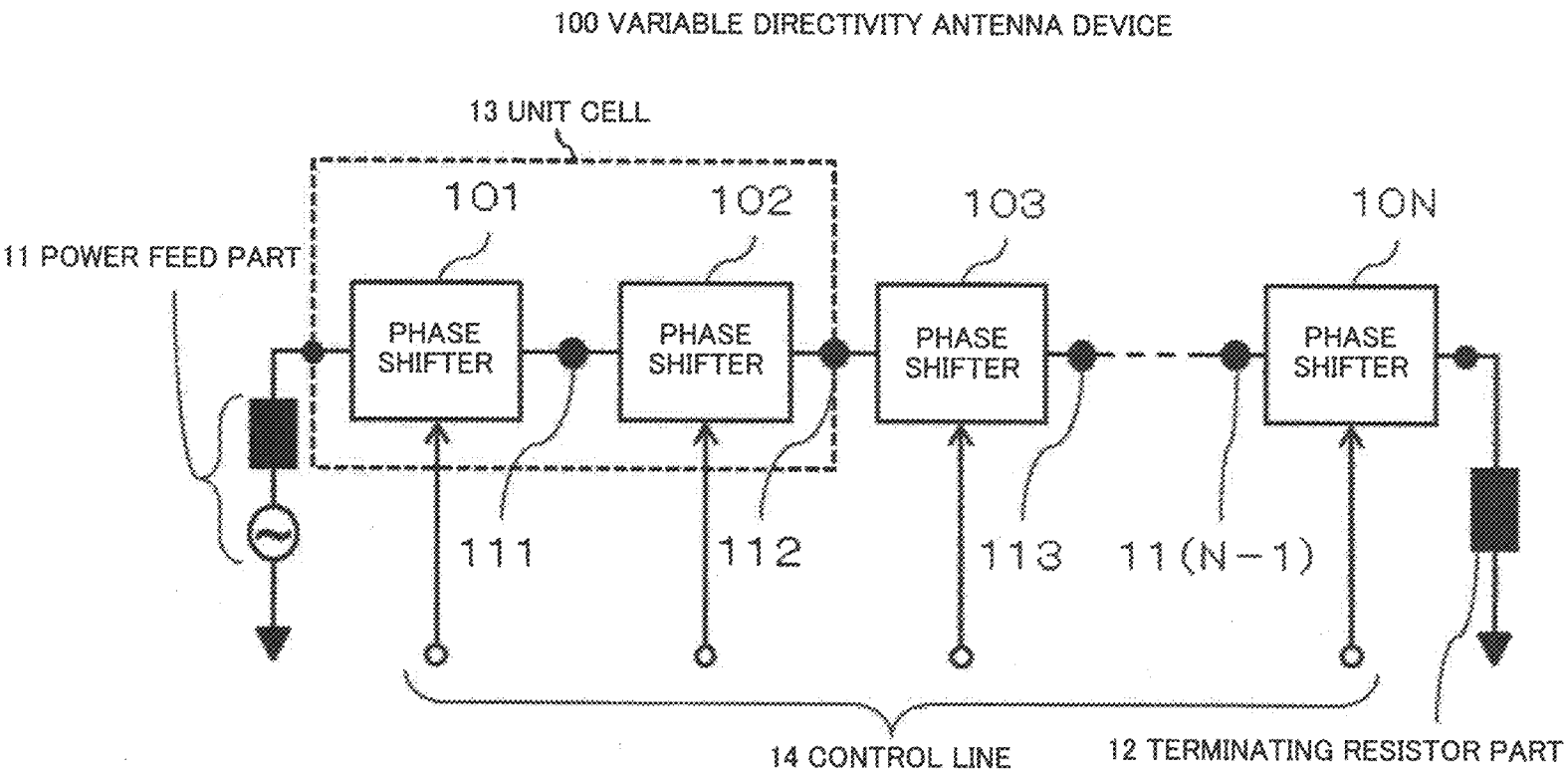
FIG. 2 is a block diagram illustrating a configuration of the variable directivity antenna device including a control line according to the first exemplary embodiment of the present invention.

Each of the phase shifters 101, 102, 103, . . . , and 10N is of an open system for free space, in other words, is in a state capable of intercommunicating an electromagnetic wave with outside. The phase shifters 101, 102, 103, . . . , and 10N are constituted of three or more linearly arranged phase shifters. In the present exemplary embodiment, the phase shifters 101, 102, 103, . . . , and 10N are arranged linearly. However, these phase shifters 101, 102, 103, . . . , and 10N may be arranged non-linearly. As illustrated in FIG. 2, each of the phase shifters 101, 102, 103, . . . , and 10N preferably includes a control line 14 that transmits a control signal for controlling a phase. When the phase shifters 101, 102, . . . , and 10N are arranged in order of the phase shifter 101, the phase shifter 102, . . . , and the phase shifter 10N, a relationship between the phase shifter 101 and the phase shifter 102, a relationship between the phase shifter 102 and the phase shifter 103, . . . , and a relationship between the phase shifter 10(N−1) and the phase shifter 10N are relationships in which characteristic impedance is discontinuous at the respective connection parts 111, 112, . . . , and 11(N−1). The present exemplary embodiment has a configuration in which the connection parts 111, 112, . . . , and 11(N−1) electrically connect between the phase shifter 101 and the phase shifter 102, between the phase shifter 102 and the phase shifter 103, . . . , and between the phase shifter 10(N−1) and the phase shifter 10N, respectively, in series directly without interposing another configuration. With this configuration, the variable directivity antenna device 100 emits a radio wave from each of the connection parts 111, 112, . . . , and 11(N−1).

The phase shifters 101, 102, 103, . . . , and 10N according to the present exemplary embodiment are constituted of two types of phase shifters, in which the phase shifter 101 and the phase shifter 102 serve as a unit cell 13 and the unit cell 13 is repeatedly arranged. In other words, the phase shifter 101, the phase shifter 103, the phase shifter 105, . . . are phase shifters of an identical type, and the phase shifter 102, the phase shifter 104, the phase shifter 106, . . . are phase shifters of an identical type. However, the phase shifters 101, 102, 103, . . . , and 10N are not limited to this configuration. For example, the phase shifter 103 may be a phase shifter of a type being different from those of the phase shifter 101 and the phase shifter 102, and the phase shifters 101, 102, 103, . . . , and 10N may be constituted of three types of phase shifters. Similarly, the phase shifters 101, 102, 103, . . . , and 10N may be constituted of four or more types of phase shifters. In a case of using three or more types of phase shifters, the phase shifters 101, 102, 103, . . . , and 10N may have a structure in which a unit cell is repeatedly arranged, as in the present exemplary embodiment. The phase shifters 101, 102, 103, . . . , and 10N are arranged in such a manner that each unit cell has a periodic phase delay.

In other words, the phase shifters 101, 102, 103, . . . , and 10N are in a state in which a rotation amount of a signal phase is the same in each unit cell. The phase shifters 101, 102, 103, . . . , and 10N vary directions of radio waves emitted from the connection parts 111, 112, . . . , and 11(N−1) by controlling respective phases of the phase shifters 101, 102, 103, . . . , and 10N. In other words, the phase shifters 101, 102, 103, . . . , and 10N are able to scan a radiation beam of the variable directivity antenna device 100.

The connection parts 111, 112, . . . , and 11(N−1) electrically connect, in sequence, between the phase shifter 101 and the phase shifter 102, between the phase shifter 102 and the phase shifter 103, . . . , and between the phase shifter 10(N−1) and the phase shifter 10N, in series directly without interposing another configuration. The connection parts 111, 112, . . . , and 11(N−1) emit radio waves by using discontinuity of characteristic impedance between connected phase shifters. This principle will be briefly described. Electromagnetic signals supplied to the phase shifter 101 pass through the phase shifters 101, 102, 103, . . . , and 10N in sequence and propagate to the terminating resistor part 12. However, when impedance is discontinuous at the connection parts 111, 112, . . . , and 11(N−1), which are junction points between the respective phase shifters 101, 102, 103, . . . , and 10N, not all of the signals can be propagated to a phase shifter at a connection destination. In this case, a part of the signals leaks as being a radio wave from each of the connection parts 111, 112, . . . , and 11(N−1). Radio waves respectively emitted from these connection parts 111, 112, . . . , and 11(N−1) are combined to form a beam of the variable directivity antenna device 100.

The power feed part 11 is connected with one end (in the present exemplary embodiment, the phase shifter 101) of the arrangement structure of the phase shifters 101, 102, 103, . . . , and 10N. The power feed part 11 supplies electromagnetic signals to the variable directivity antenna device 100.

The terminating resistor part 12 is connected with an end portion (in the present exemplary embodiment, the phase shifter 10N) of the arrangement structure of the phase shifters 101, 102, 103, . . . , and 10N on a side where the power feed part 11 is not connected. The terminating resistor part 12 prevents unnecessary reflection of a terminating part of the variable directivity antenna device 100.

Next, with reference to FIG. 3, an embodied configuration of the phase shifters 101, 102, 103, . . . , and 10N of the variable directivity antenna device 100 illustrated in FIG. 1 will be described. Phase shifters 201, 202, 203, . . . , and 20N, a unit cell 23, connection parts 211, 212, . . . , and 21(N−1), a power feed part 21, and a terminating resistor part 22 have functions being the same as those of the phase shifters 101, 102, 103, . . . , and 10N, the unit cell 13, the connection parts 111, 112, . . . , and 11(N−1), the power feed part 11, and the terminating resistor part 12 in FIG. 1, respectively, and thus, detailed description therefor will be omitted.

Each of the phase shifters 201, 202, 203, . . . , and 20N is constituted of two variable reactance elements connected to each other and shunted with the hybrid coupler.

Next, with reference to FIGS. 4 and 5, a configuration of the phase shifters 201, 202, 203, . . . , and 20N illustrated in FIG. 3 will be described in detail.

Figure 3:
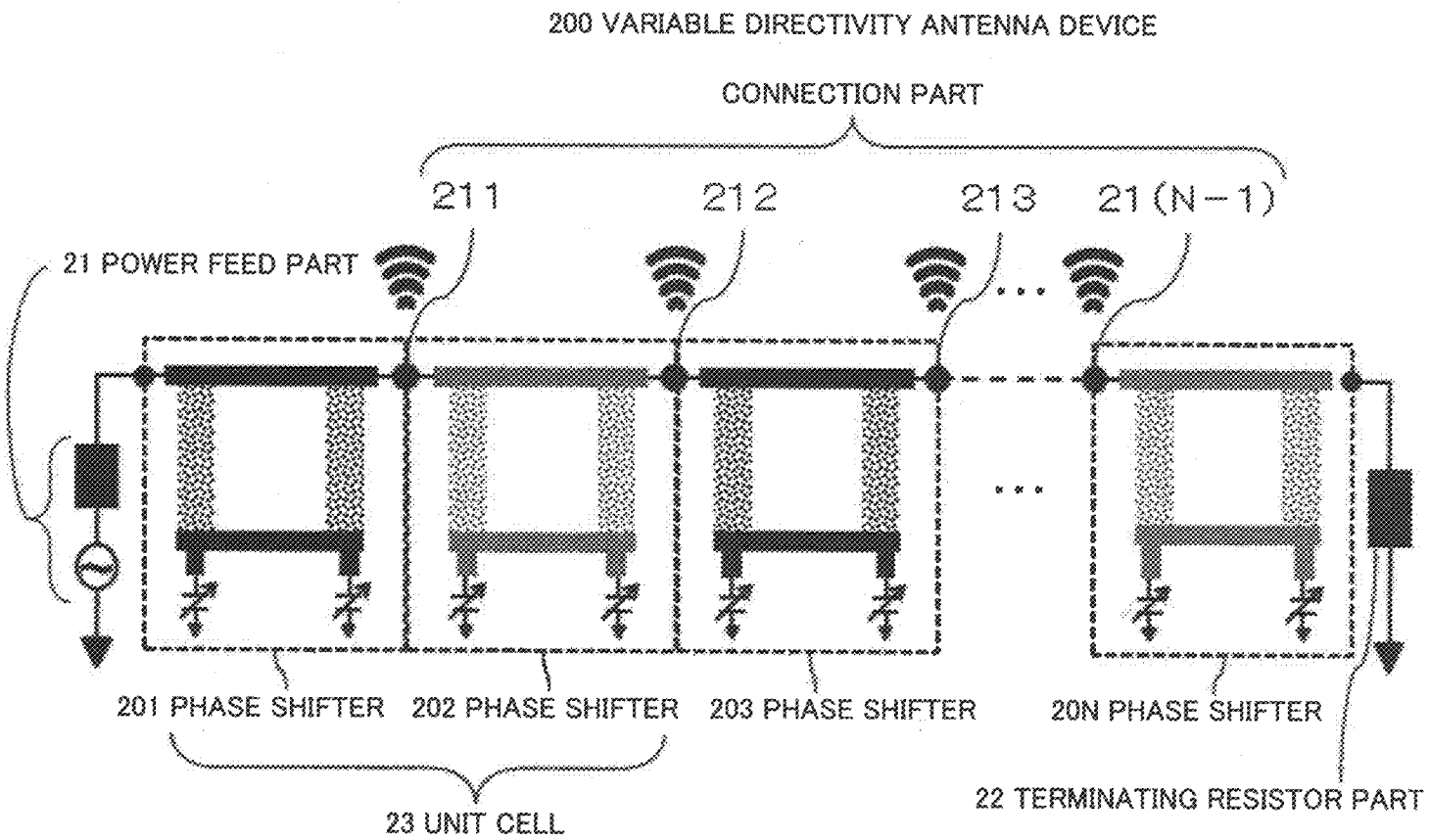
FIG. 3 is a block diagram illustrating an embodied configuration of the variable directivity antenna device according to the first exemplary embodiment of the present invention.
Figure 4:
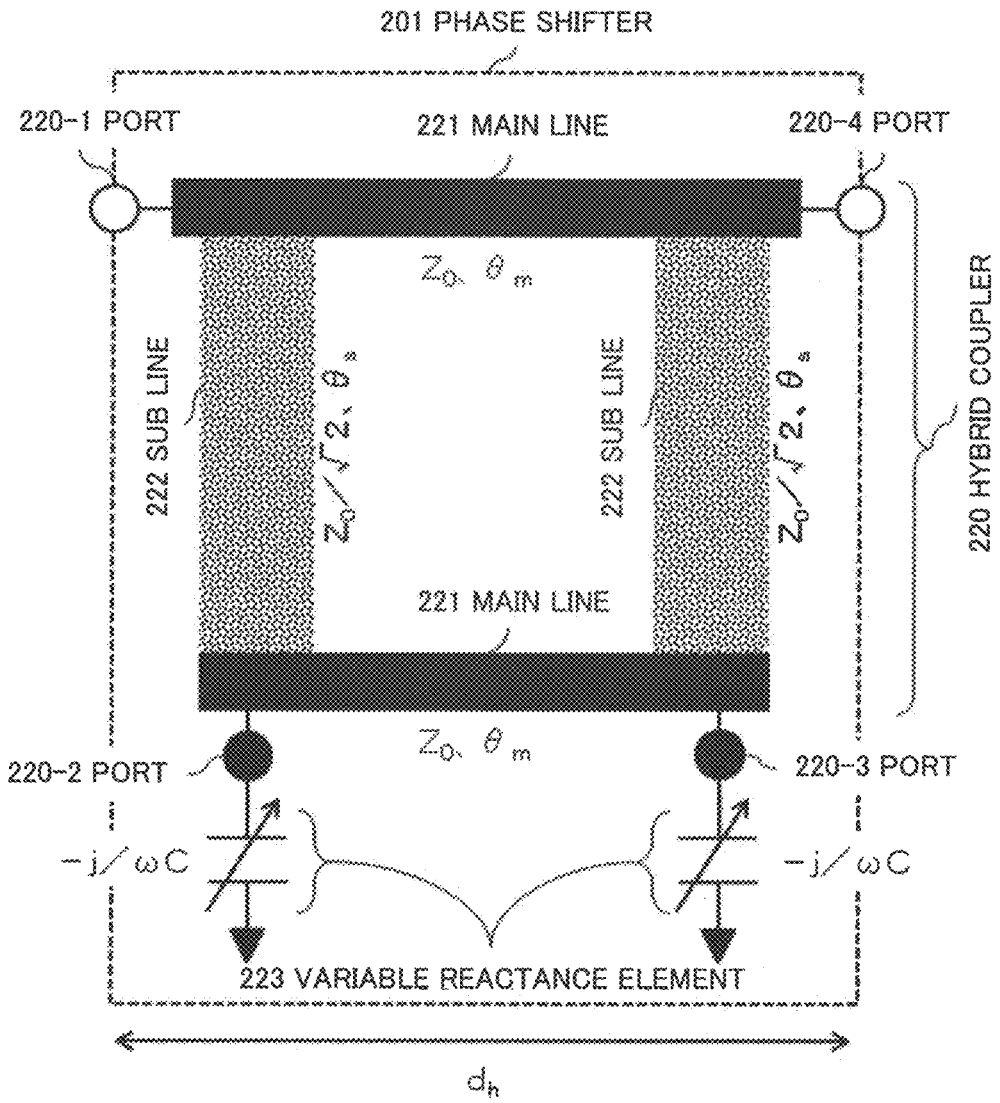
FIG. 4 is an enlarged diagram of a phase shifter used in the embodied configuration of the variable directivity antenna device according to the first exemplary embodiment of the present invention.

FIG. 4 is an enlarged diagram illustrating a configuration of the phase shifter 201 illustrated in FIG. 3. The phase shifter 201 includes a hybrid coupler 220 including a main line 221 and a sub line 222, and variable reactance elements 223.

The hybrid coupler 220 sets the main line 221 and the sub line 222 so as to have electrical lengths θm and θs of 90° at a desired frequency. Herein, when a characteristic impedance of the main line 221 is Z0 and a characteristic impedance of the sub line 222 is Z0/√2, the hybrid coupler 220 operates as an element called a 3 dB branch line coupler. In a case in which the hybrid coupler 220 is not connected with the variable reactance elements 223, upon input of a signal to a port 220-1, ports 220-2 and 220-3 output signals with respectively halved electric power. At this time, a port 220-4 outputs no signal. This is a basic operation of the 3 dB branch line coupler. On the other hand, in a case in which the hybrid coupler 220 is connected with the respective short-circuited variable reactance elements 223 at the ports 220-2 and 220-3, the hybrid coupler 220 and the variable reactance elements 223 operate as a phase shifter. The hybrid coupler 220 according to the present exemplary embodiment employs the latter configuration. Upon input of a signal to the port 220-1, the hybrid coupler 220 outputs a signal from the port 220-4.

An S-matrix relating to the ports 220-1 and 220-4 is written as follows.

[Mathematical Expression 1]

$$\begin{pmatrix} S_{11} & S_{14} \\ S_{41} & S_{44} \end{pmatrix} = \begin{pmatrix} 0 & -j\frac{(1-X_T^2)-j2X_T}{1+X_T^2} \\ -j\frac{(1-X_T^2)-j2X_T}{1+X_T^2} & 0 \end{pmatrix} = \begin{pmatrix} 0 & e^{-j\frac{\pi}{2}}e^{j\phi} \\ e^{-j\frac{\pi}{2}}e^{j\phi} & 0 \end{pmatrix} \quad (1)$$

Herein, XT is XT=−1/ωCZ0, where ω is an angular frequency expressed as ω=2πf with use of a frequency f. In addition, is a phase component of S-parameters S41 and S14. From a form of the S-parameters S41 and S14, absolute values of the S-parameters S41 and S14 are both 1 at a desired frequency, which in principle perfectly transmits a signal between the port 220-1 and port 220-4.

In addition, the phase component φ of the S-parameters S41 and S14 is expressed as follows, with use of a capacitance value C of the variable reactance element 223.

[Mathematical Expression 2]

$$\phi = -2\tan^{-1}\left(-\frac{1}{\omega CZ_0}\right) \quad (2)$$

Accordingly, the phase shifter 201 is able to control the phase φ while maintaining perfect transmission between the port 220-1 and the port 220-4, by sweeping the capacitance value C of the variable reactance element 223. Note that the phase shifter 201 can shift an operating frequency of a phase shifter, by varying lengths and widths of the main line 221 and sub line 222 of the hybrid coupler 220 and adjusting the electrical lengths θm and θs.

A distance dh represents a distance between the port 220-1 and the port 220-4 of the hybrid coupler 220.

Figure 5:
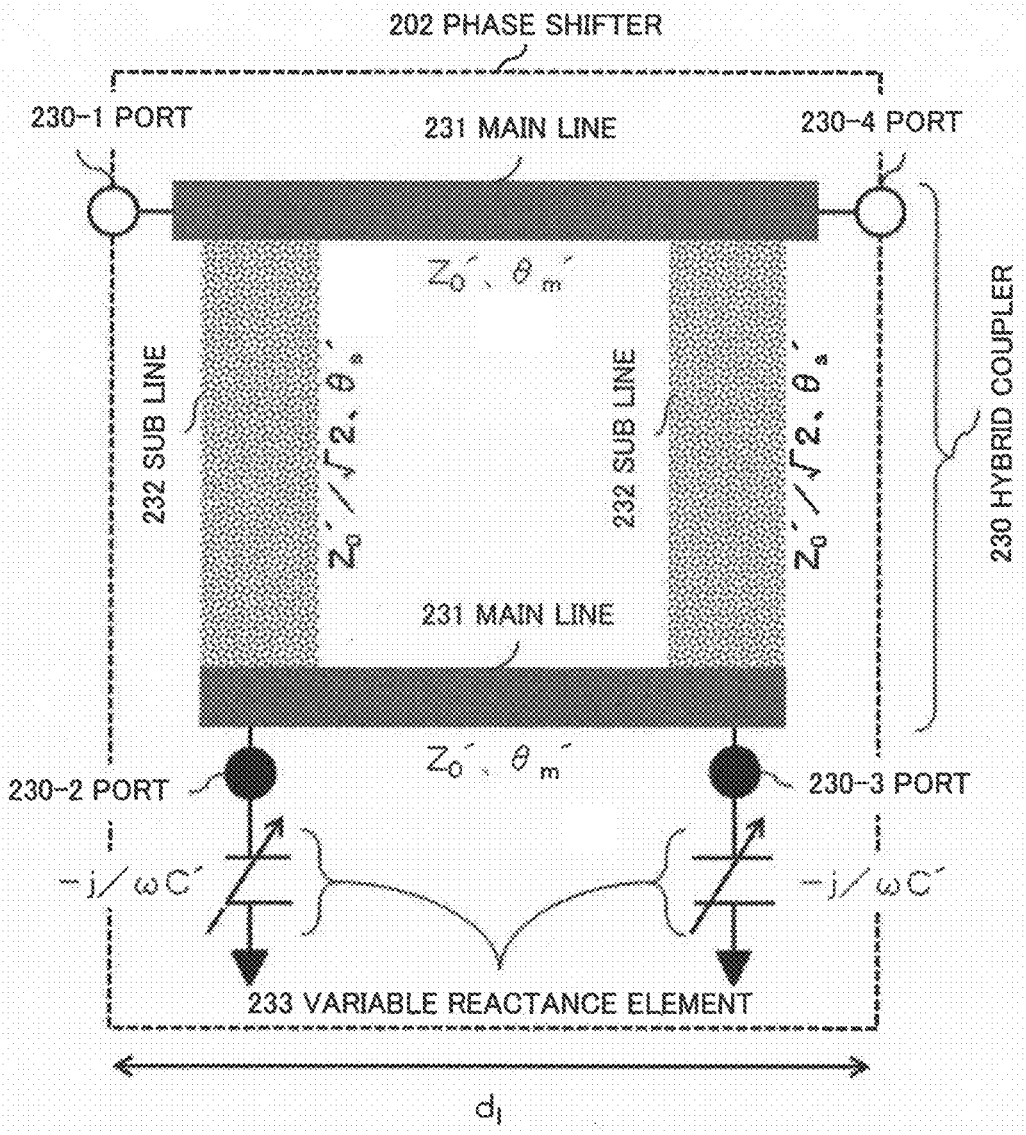
FIG. 5 is an enlarged diagram of a phase shifter used in the embodied configuration of the variable directivity antenna device according to the first exemplary embodiment of the present invention.

Similarly, FIG. 5 is an enlarged diagram illustrating a configuration of the phase shifter 202 illustrated in FIG. 3. The phase shifter 202 includes a hybrid coupler 230 including a main line 231 and a sub line 232, and variable reactance elements 233. The phase shifter 202, the main line 231, the sub line 232, and the variable reactance elements 233 have functions being the same as those of the phase shifter 201, the main line 221, the sub line 222, and the variable reactance elements 223 in FIG. 4, respectively, and thus, detailed description therefor will be omitted.

A distance dl represents a distance between a port 230-1 and a port 230-4 of the hybrid coupler 230.

Figure 6A:
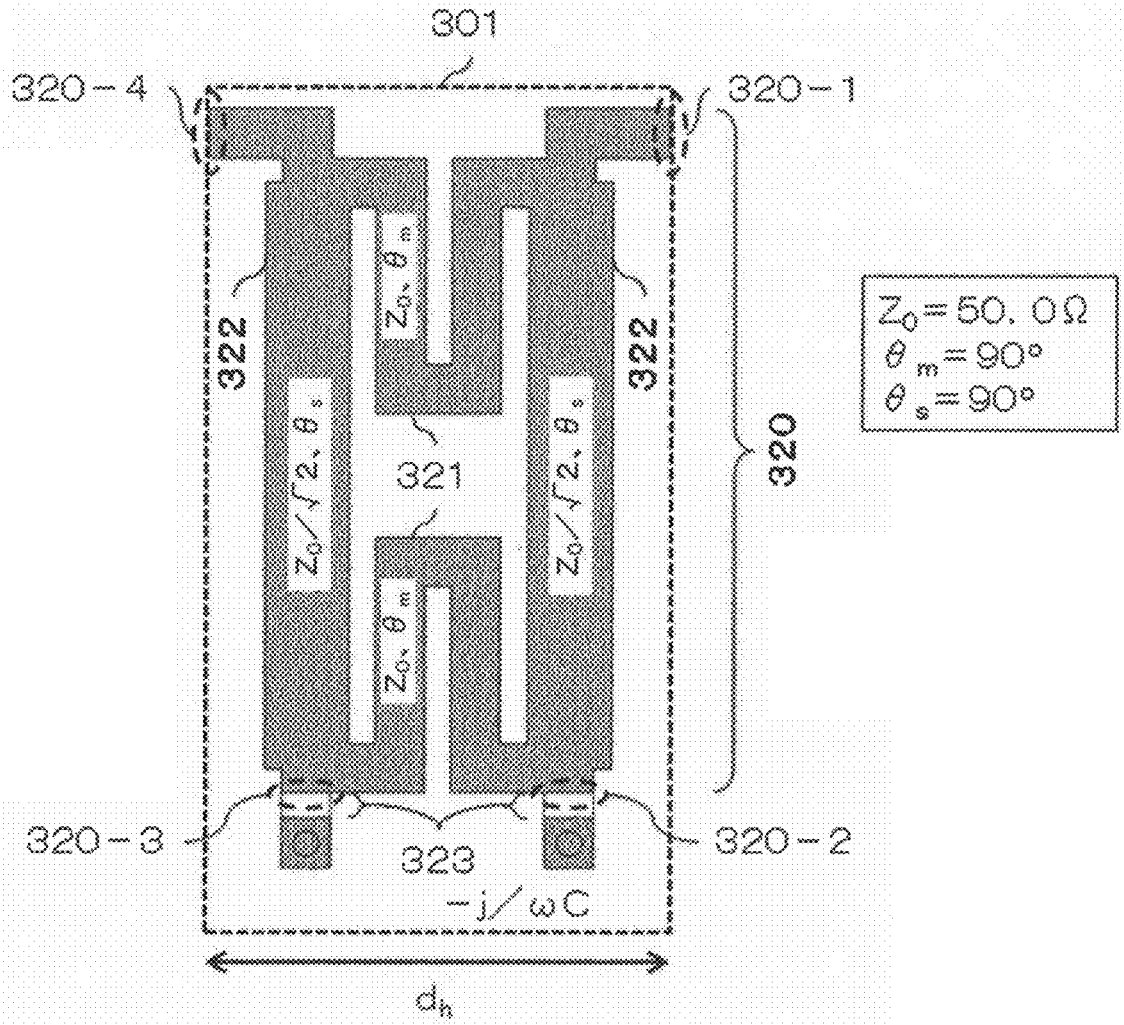
FIG. 6A is an enlarged diagram of a phase shifter used in a specific configuration of the variable directivity antenna device according to the first exemplary embodiment of the present invention.

With reference to FIG. 6A, a phase shifter 301 that is a specific configuration of the phase shifter 201 will be described. In the present exemplary embodiment, a hybrid coupler 320 is designed in such a manner that a main line 321 and a sub line 322 have characteristic impedances Z0 and Z0/√2 of 50.0Ω and 35.4Ω, respectively. The hybrid coupler 320 has ports 320-2 and 320-3 respectively connected with one-end portions of variable reactance elements 323, and another-end portions short-circuited by a ground plate.

Similarly, with reference to FIG. 6B, a phase shifter 302 that is a specific configuration of the phase shifter 202 will be described. A hybrid coupler 330 is designed in such a manner that a main line 331 and a sub line 332 have a characteristic impedance Z0' of 16.0Ω and a characteristic impedance Z0'/√2 of 11.3Ω, respectively. The hybrid coupler 330 has ports 330-2 and 330-3 respectively connected with short-circuited variable reactance elements 333.

Next, with reference to FIG. 7, a configuration of a unit cell 33 obtained by connecting a port 320-4 of the phase shifter 301 illustrated in FIG. 6A with a port 330-1 of the phase shifter 302 illustrated in FIG. 6B will be described.

The port 320-4 and the port 330-1 have largely different characteristic impedances Z0 and Z0' of 50.0Ω and 16.0Ω, respectively. This state can be regarded as a state in which characteristic impedance is discontinuous for a signal propagating through a phase shifter. Thus, a radio wave is emitted from a connection part 311 between the phase shifter 301 and the phase shifter 302. For facilitating radiation of a radio wave from the connection part 311, it is effective to narrow the width of the main line of the phase shifter 301 and to widen the width of the main line of the phase shifter 302 in a manner to increase a difference in characteristic impedance. A distance d is a distance between a port 320-1 and a port 330-4 and is expressed by a sum of the distance dh in FIG. 6A and the distance dl in FIG. 6B, such as d=dh+dl. By arranging the unit cell 33 at a periodic interval of the distance d, the variable directivity antenna device according to the first exemplary embodiment maintain periodicity of a phase delay in the unit cell 33. In addition, by setting the distance d to be less than half a wavelength of an electromagnetic wave in free space, a variable directivity antenna device having a wider beam scan range is realized. This configuration enhances a radiation efficiency because of dense arrangement of phase shifters.

Herein, as a preparation for describing an operation principle of the variable directivity antenna device according to the present exemplary embodiment, some important parameters will be introduced. There is Floquet's theorem (in Solid-state physics, also referred to as Bloch's theorem) that describes a characteristic of an electromagnetic wave in a periodic structure as in FIG. 3. According to Floquet's theorem, in the periodic structure in which the unit cell 33 is arranged at a length of the unit cell 33, in other words, at the periodic interval d, a voltage VN and a current IN of a signal at a terminal number N are expressed as follows, with use of an F-matrix [A, B, C, D] and a propagation constant $\gamma \equiv \alpha + j\beta$.

[Mathematical Expression 3]

$$\begin{pmatrix} V_N \\ I_N \end{pmatrix} = \begin{pmatrix} A & B \\ C & D \end{pmatrix} \begin{pmatrix} V_{N+1} \\ I_{N+1} \end{pmatrix} = e^{\gamma d} \begin{pmatrix} V_{N+1} \\ I_{N+1} \end{pmatrix} \tag{3}$$

At this time, in order for the voltage VN and the current IN to have non-zero solutions, Expression (3) is transformed as follows.

[Mathematical Expression 4]

$$\begin{pmatrix} A - e^{\gamma d} & B \\ C & D - e^{\gamma d} \end{pmatrix} \begin{pmatrix} V_{N+1} \\ I_{N+1} \end{pmatrix} = 0 \tag{4}$$

At this time, a determinant of the matrix on the left side in Expression (4) needs to be zero.

[Mathematical Expression 5]

$$A = \frac{(1 + S_{11})(1 - S_{44}) + S_{14}S_{41}}{2S_{41}} \tag{5.1}$$

$$D = \frac{(1 - S_{11})(1 + S_{44}) + S_{14}S_{41}}{2S_{41}} \tag{5.2}$$

When using Expression (2) and the fact that F-matrix components A and D are expressed by Expressions (5.1) and (5.2), the following relational expression is obtained regarding the propagation constant γ.

[Mathematical Expression 6]

$$\gamma d = (\alpha + j\beta)d = \cosh^{-1}\left(\frac{A + D}{2}\right) = \cosh^{-1}\left(\frac{1 + e^{j2\phi}}{2e^{j\phi}}\right) \tag{6}$$

Herein, α is called an attenuation constant representing an attenuation term of a signal. When the attenuation constant α is finite, a signal attenuates as propagating through a periodic structure. On the other hand, β is called a phase constant. The phase constant β represents a phase delay per unit length of a propagating signal.

The attenuation constant α and the phase constant β are dependent on a frequency. Thus, characteristics of the attenuation constant α and the phase constant β determine an operation of the variable directivity antenna device according to the first exemplary embodiment. In order to secure an operation as an antenna, at least the attenuation constant α does not desirably take a remarkably large value in a use band. The reason is that an input signal attenuates as propagating through arranged phase shifters and thus cannot efficiently propagate, failing to feed electric power to an overall antenna device. A band where the attenuation constant α takes a large value as described above is called a band gap, a stopband, and the like.

On the other hand, a direction θ of a beam main axis of a radiation beam of an antenna is written as follows, with use of the phase constant β.

[Mathematical Expression 7]

$$\theta = \sin^{-1}\left(\frac{\beta}{k_0}\right) \tag{7}$$

Herein, k0 is a wavenumber of free space. However, a condition where Expression (7) holds, in other words, a condition where an antenna radiates, is limited to a case in which a relation of $|\beta|<|k0|$ is satisfied. When $\theta=0°$, a total value of phase delays in the respective phase shifters 301, 302, 303, . . . , and 30N is an integral multiple of a value twice a circumference ratio.

Adjustment of the phase constant β may be structural control of the unit cell 33, or may be electrical characteristic control of the unit cell 33. By adjusting the phase constant β appropriately, a variable directivity antenna device is realized that can form a radiation beam in a desired direction. In addition, as can be seen from Expression (6), the phase constant β is a parameter also closely relevant to the phase component φ of a phase shifter. Controlling a phase of a phase shifter is equivalent to controlling the phase constant β itself.

Figure 7:
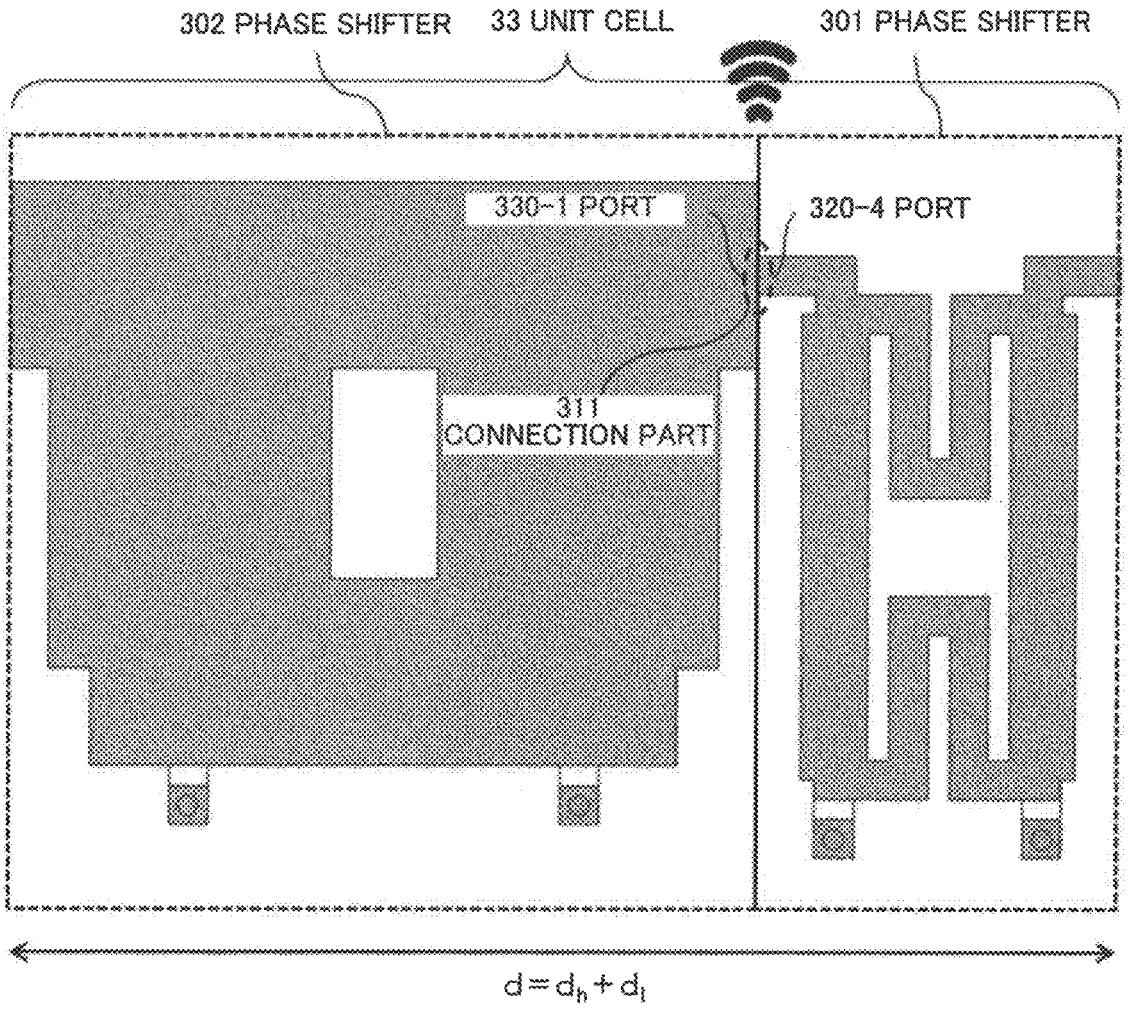
FIG. 7 is a diagram exemplifying a configuration of a unit cell used in the specific configuration of the variable directivity antenna device according to the first exemplary embodiment of the present invention.
Figure 8:
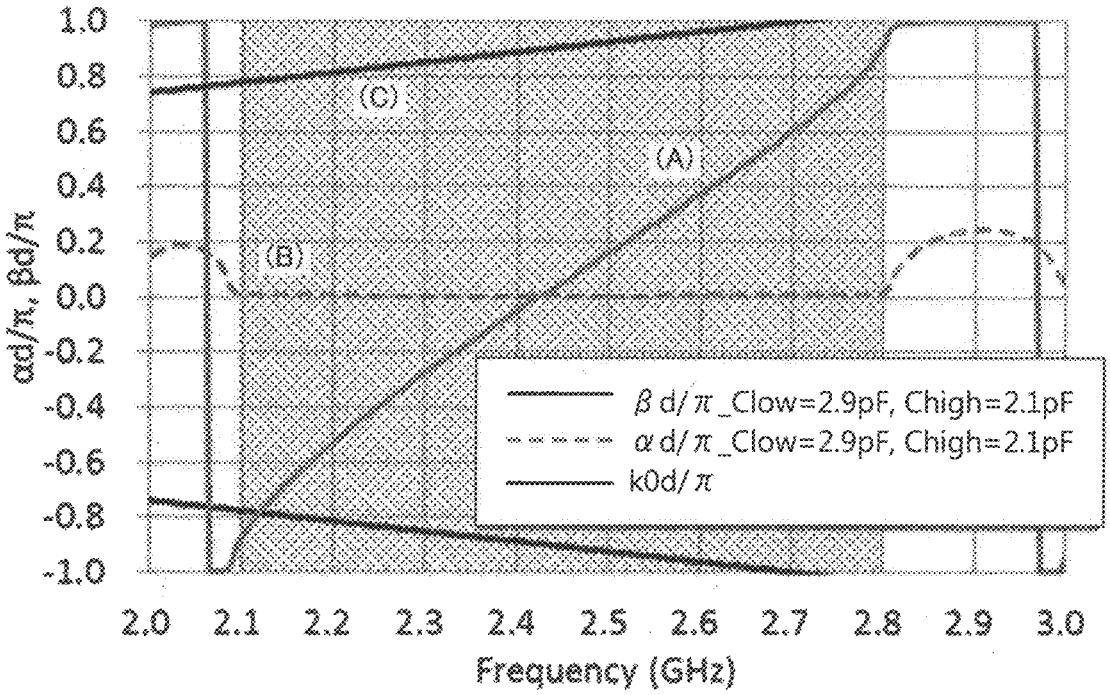
FIG. 8 is a graph illustrating frequency characteristics of an attenuation constant and a phase constant in a unit cell used in the specific configuration of the variable directivity antenna device according to the first exemplary embodiment of the present invention.

FIG. 8 is a dispersion relation illustrating a result of analysis on frequency characteristics of the attenuation constant α and the phase constant β of the unit cell 33 illustrated in FIG. 7. In FIG. 8, a solid line (A) indicates the phase constant β, a dotted line (B) indicates the attenuation constant α, and a solid line (C) indicates the wavenumber k0 of free space. Each parameter is multiplied by d/π for convenience. Herein, near frequencies of 2.05 GHz and 2.90 GHz, the attenuation constant α has a finite value, in other words, a band gap. It can be understood that the unit cell 33 is unable to contribute to radiation in this band. On the other hand, in a band from 2.1 GHz to 2.8 GHz, the attenuation constant α is substantially zero. In other words, a signal propagates through a periodic structure without attenuation. Then, in the band, a relation of $|\beta|<|k0|$ is satisfied at the same time. From this fact, it can be understood that a periodic structure on a unit cell 23 basis contributes to radiation.

Figure 6B:
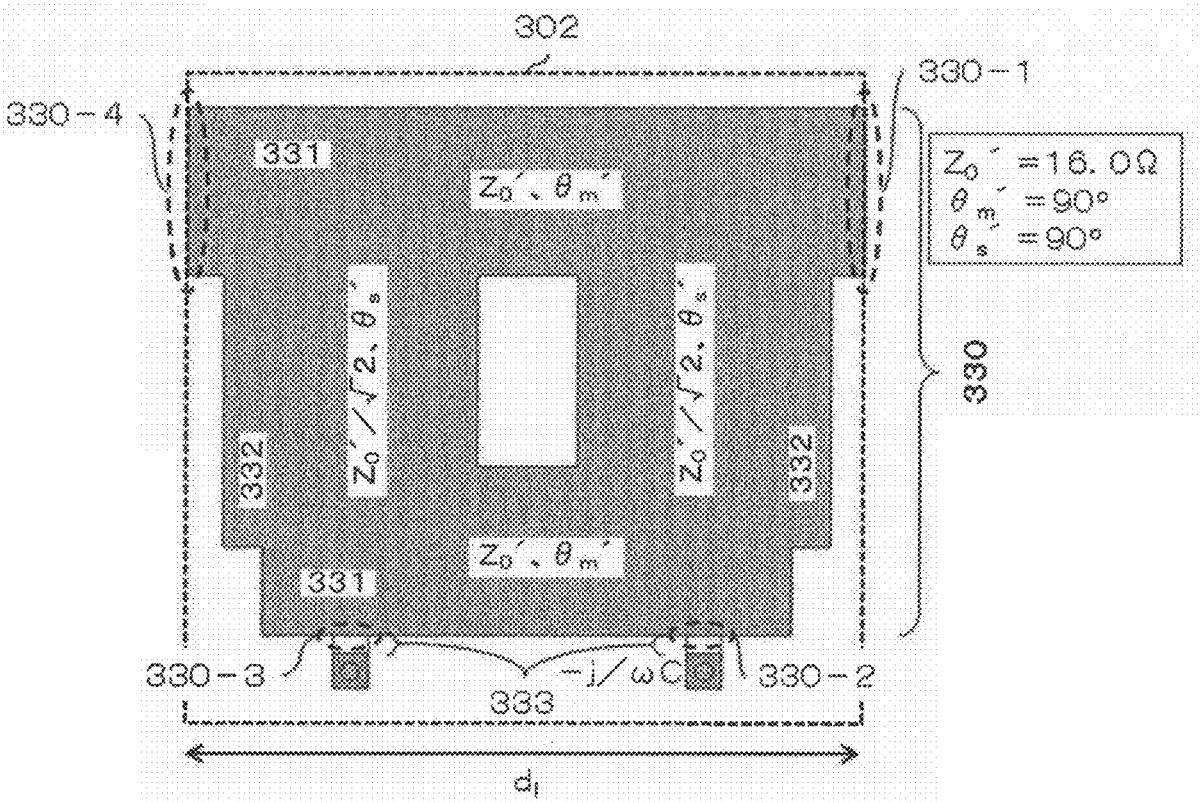
FIG. 6B is an enlarged diagram of a phase shifter used in the specific configuration of the variable directivity antenna device according to the first exemplary embodiment of the present invention.
Figure 9:
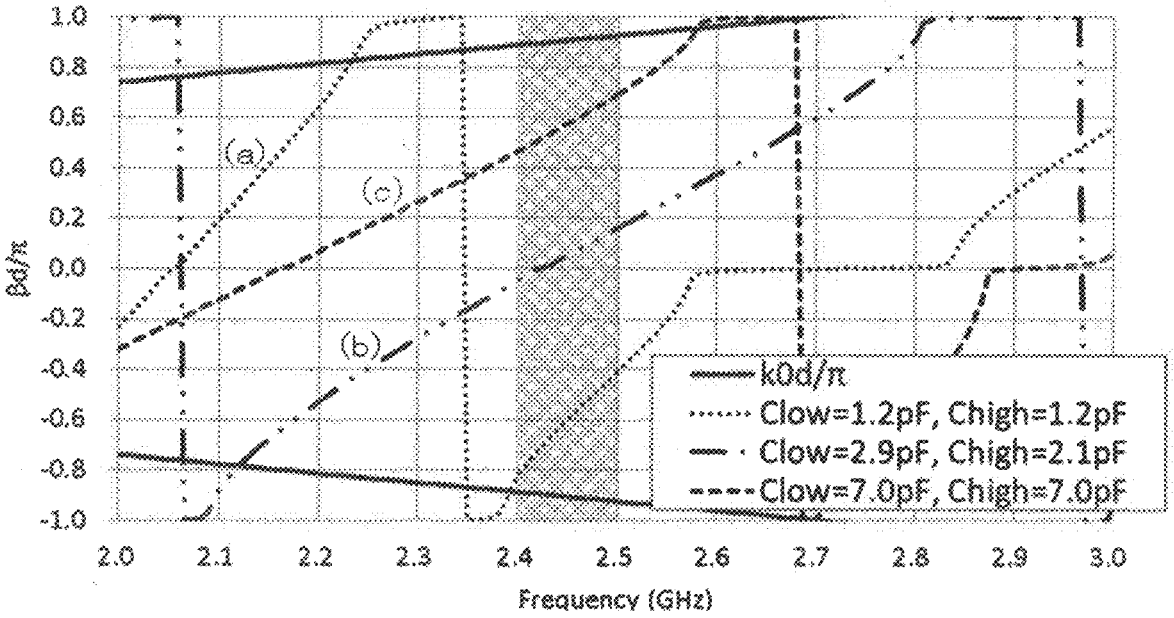
FIG. 9 is a graph illustrating a frequency characteristic of a phase constant in a unit cell used in the specific configuration of the variable directivity antenna device according to the first exemplary embodiment of the present invention.

FIG. 9 illustrates a frequency characteristic of the phase constant β in a case of varying respective capacitance values of the variable reactance element 323 in FIG. 6A and the variable reactance element 333 in FIG. 6B as (a) Clow=1.2 pF, Chigh=1.2 pF, (b) Clow=2.9 pF, Chigh=2.1 pF, and (c) Clow=7.0 pF, Chigh=7.0 pF, where Chigh is the variable reactance element 323 and Clow is the variable reactance element 333. In FIG. 9, when focusing on a frequency range from 2.4 GHz to 2.5 GHz, it can be seen that a value of the phase constant β increases in order of (a), (b), and (c). In other words, according to Expression (7), a main axis direction of a radiation beam is swept by control of the capacitance value C of a variable reactance element.

Figure 10:
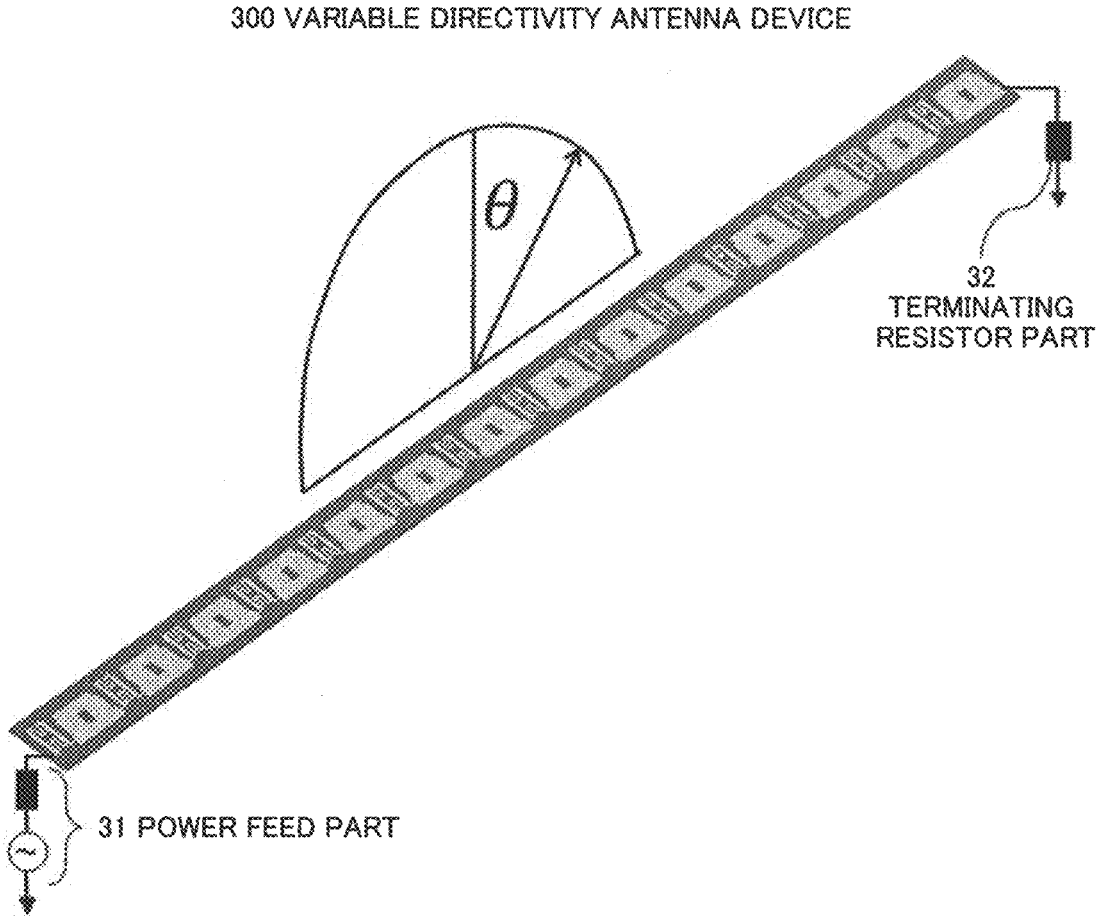
FIG. 10 is a diagram exemplifying the specific configuration of the variable directivity antenna device according to the first exemplary embodiment of the present invention.
Figure 11:
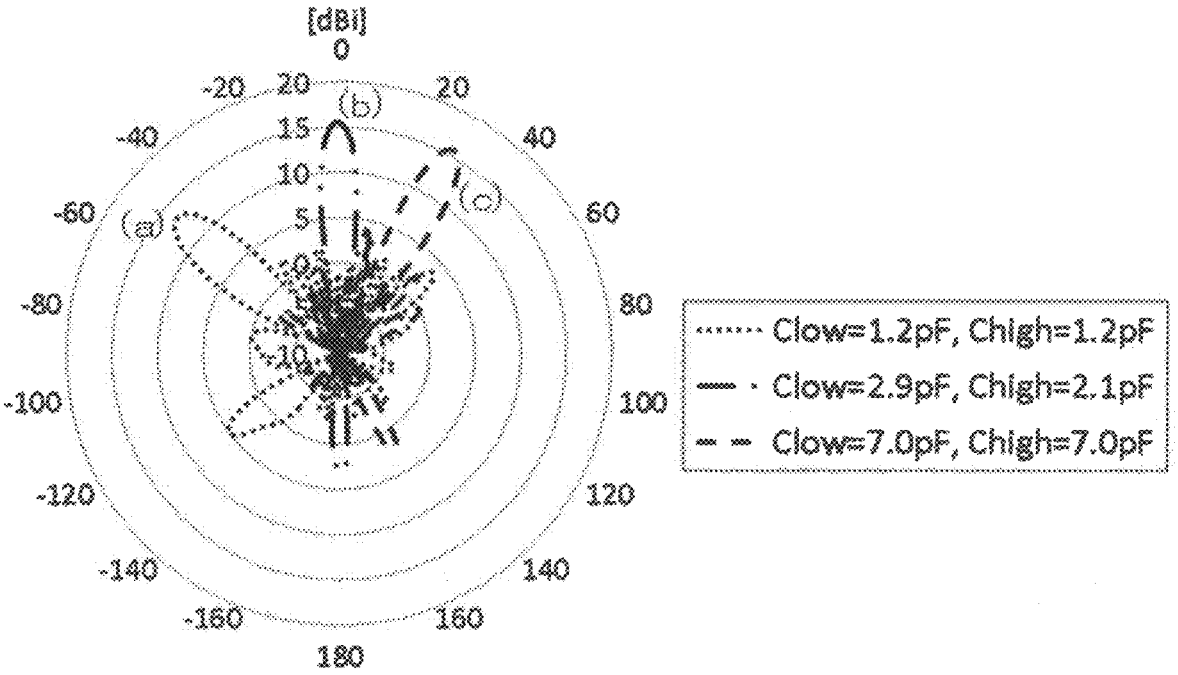
FIG. 11 is a graph illustrating a radiation pattern in the specific configuration of the variable directivity antenna device according to the first exemplary embodiment of the present invention.

To confirm the above, reference is made to a radiation beam of a variable directivity antenna device 300 (see FIG. 10) illustrated in FIG. 11, the variable directivity antenna device 300 being configured by repeatedly arranging the unit cell 33 in FIG. 7. Herein, an angle θ illustrated in FIG. 10 is equivalent to the main axis direction of the radiation beam expressed by Expression (7). The variable directivity antenna device 300 is fed with electric power from a power feed part 31. In addition, the variable directivity antenna device 300 is short-circuited at a terminating resistor part 32.

FIG. 11 is a radiation pattern diagram of the variable directivity antenna device 300 in FIG. 10. It can be seen that, by varying a capacitance value in order of (a), (b), and (c), the main axis direction θ of the radiation beam actually varies over a wide range, +25°, 0°, and −45°.

In the first exemplary embodiment of the present invention, a variable directivity antenna is constituted of only phase shifters, without using an antenna element. This realizes a smaller-sized antenna having a wider beam scan range. In addition, the phase shifter according to the present exemplary embodiment is constituted of a hybrid coupler and a variable reactance element in combination. Since a phase is controlled by controlling the variable reactance element, a return loss per phase shifter can be minimized. Therefore, the variable directivity antenna device according to the present exemplary embodiment is able to perform beam scanning for a wider range.

[Second Exemplary Embodiment]

A second exemplary embodiment of a variable directivity antenna device according to the present invention will be described in detail with reference to the drawings.

Figure 12:
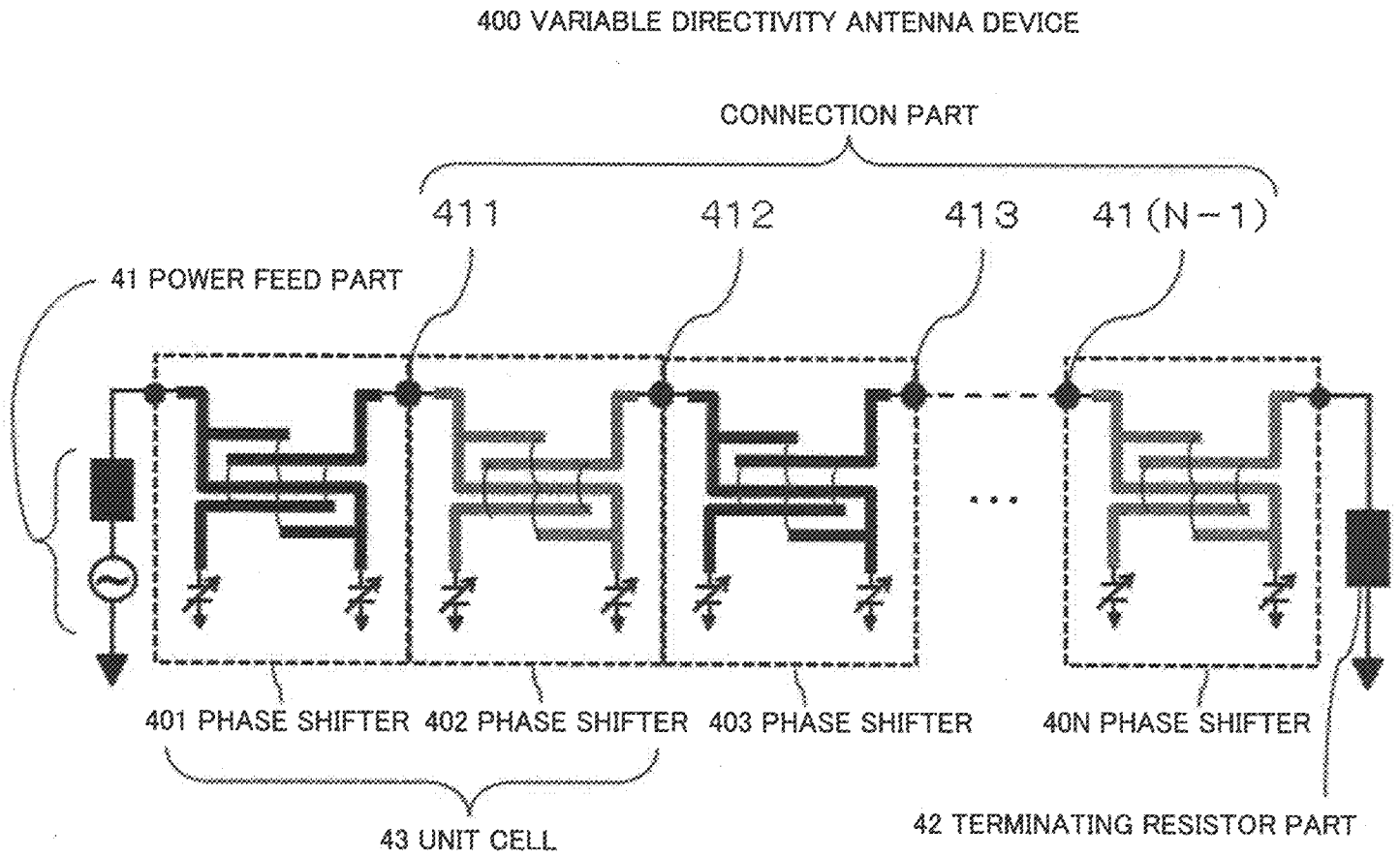
FIG. 12 is a block diagram illustrating a configuration of a variable directivity antenna device according to a second exemplary embodiment of the present invention.

First, with reference to FIG. 12, a configuration example according to the second exemplary embodiment will be described. FIG. 12 is a block diagram illustrating a configuration example of a variable directivity antenna device 400 according to the second exemplary embodiment. The variable directivity antenna device 400 according to the second exemplary embodiment includes phase shifters 401, 402, 403, . . . , and 40N, connection parts 411, 412, . . . , and 41(N−1), a power feed part 41, and a terminating resistor part 42. The phase shifters 401, 402, 403, . . . , and 40N, a unit cell 43, the connection parts 411, 412, . . . , and 41(N−1), the power feed part 41, and the terminating resistor part 42 have functions being the same as those of the phase shifters 101, 102, 103, . . . , and 10N, the unit cell 13, the connection parts 111, 112, . . . , and 11(N−1), the power feed part 11, and the terminating resistor part 12 according to the first exemplary embodiment, respectively. Thus, detailed description therefor will be omitted. The phase shifters 401, 402, 403, . . . , and 40N according to the present exemplary embodiment are specific examples being different from the phase shifters 201, 202, 203, . . . , and 20N, which are the specific examples of the phase shifters 101, 102, 103, . . . , and 10N according to the first exemplary embodiment described above.

With reference to FIG. 12, an embodied configuration of the phase shifters 101, 102, 103, . . . , and 10N of the variable directivity antenna device 100 illustrated in FIG. 1 will be described.

Each of the phase shifters 401, 402, 403, . . . , and 40N is constituted of two variable reactance elements connected to each other and short-circuited with the Lange coupler.

Figure 13:
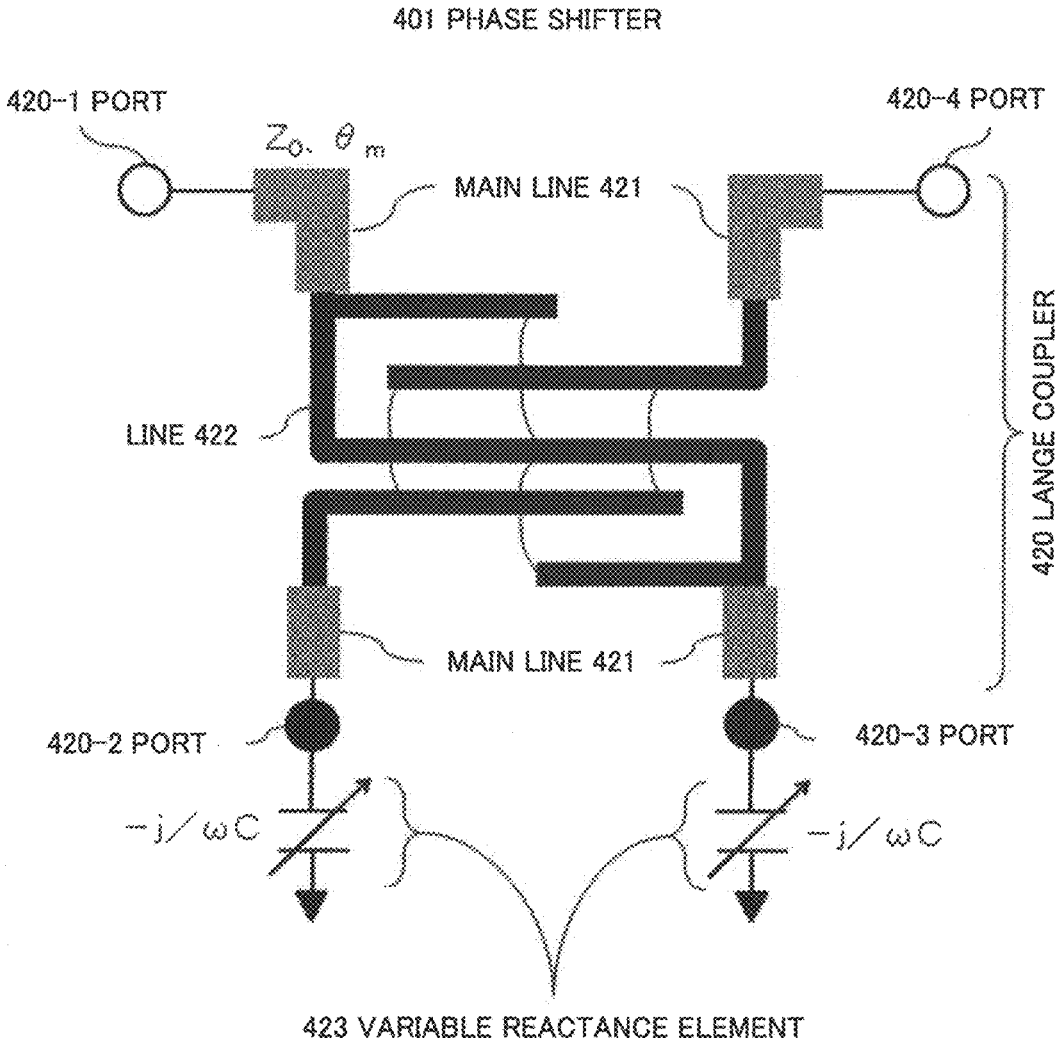
FIG. 13 is an enlarged diagram of a phase shifter used in the configuration of the variable directivity antenna device according to the second exemplary embodiment of the present invention.

FIG. 13 is an enlarged diagram illustrating a configuration of the phase shifter 401 illustrated in FIG. 12. The phase shifter 401 includes a Lange coupler 420 and variable reactance elements 423. The phase shifter 401 is able to control a phase by sweeping a capacitance value C of the variable reactance element 423, without varying a transmission coefficient between a port 420-1 and a port 420-4, in other words, with no loss. Note that the phase shifter 401 varies a length, a width, and an interval of a comb-shaped line 422 of the Lange coupler 420 and adjusts a capacitance and an electrical length θm formed in the coupler. The adjustment of these parameters makes it possible to shift an operating frequency of a phase shifter.

The Lange coupler 420 has a structure in which the line 422 is arranged in a comb shape, at a plurality of portions of which bridge lines are connected so as to link two distant points. The Lange coupler 420 includes the port 420-1, a port 420-2, a port 420-3, and the port 420-4. Immediately close to the port 420-1, the port 420-2, the port 420-3, and the port 420-4, a main line 421 having a characteristic impedance Z0 is connected. The Lange coupler 420 is connected with the respective short-circuited variable reactance elements 423 at the port 420-2 and the port 420-3. Upon input of a signal to the port 420-1, the Lange coupler 420 outputs a signal from the port 420-4.

In the second exemplary embodiment of the present invention, a variable directivity antenna is constituted of only phase shifters, without using an antenna element. This realizes a smaller-sized antenna having a wider beam scan range. In addition, the Lange coupler 420 constituting a phase shifter operates as a hybrid coupler, similarly to the branch line coupler according to the first exemplary embodiment. In other words, since a phase is controlled by controlling a variable reactance element, a return loss per phase shifter can be minimized. Therefore, the variable directivity antenna device according to the present exemplary embodiment is able to perform beam scanning for a wide range.

[Third Exemplary Embodiment]

A third exemplary embodiment of a variable directivity antenna device according to the present invention will be described in detail with reference to the drawings.

Figure 14:
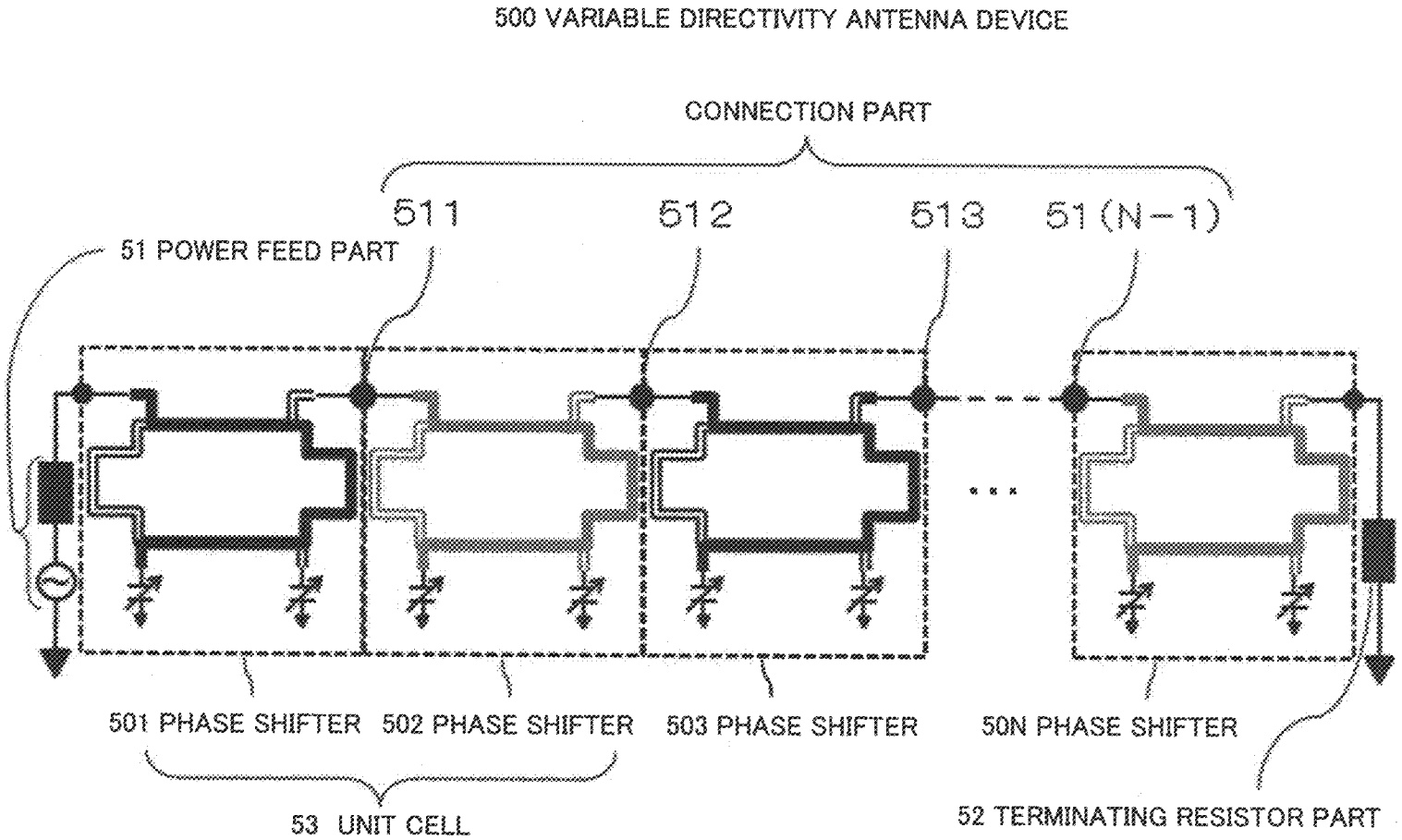
FIG. 14 is a block diagram illustrating a configuration of a variable directivity antenna device according to a third exemplary embodiment of the present invention.

First, with reference to FIG. 14, a configuration example according to the third exemplary embodiment will be described. FIG. 14 is a block diagram illustrating a configuration example of a variable directivity antenna device 500 according to the third exemplary embodiment. The variable directivity antenna device 500 according to the third exemplary embodiment includes phase shifters 501, 502, 503, . . . , and 50N, connection parts 511, 512, . . . , and 51(N−1), a power feed part 51, and a terminating resistor part 52. The phase shifters 501, 502, 503, . . . , and 50N, a unit cell 53, the connection parts 511, 512, . . . , and 51(N−1), the power feed part 51, and the terminating resistor part 52 have functions being the same as those of the phase shifters 101, 102, 103, . . . , and 10N, the unit cell 13, the connection parts 111, 112, . . . , and 11(N−1), the power feed part 11, and the terminating resistor part 12 according to the first exemplary embodiment, respectively. Thus, detailed description therefor will be omitted. The phase shifters 501, 502, 503, . . . , and 50N according to the present exemplary embodiment are specific examples being different from the phase shifters 201, 202, 203, . . . , and 20N and the phase shifters 401, 402, 403, . . . , and 40N, which are the specific examples of the phase shifters 101, 102, 103, . . . , and 10N according to the first exemplary embodiment described above.

With reference to FIG. 14, an embodied configuration of the phase shifters 101, 102, 103, . . . , and 10N of the variable directivity antenna device 100 illustrated in FIG. 1 will be described.

Each of the phase shifters 501, 502, 503, . . . , and 50N is constituted of two variable reactance elements connected to each other and short-circuited with the tandem coupler.

Figure 15:
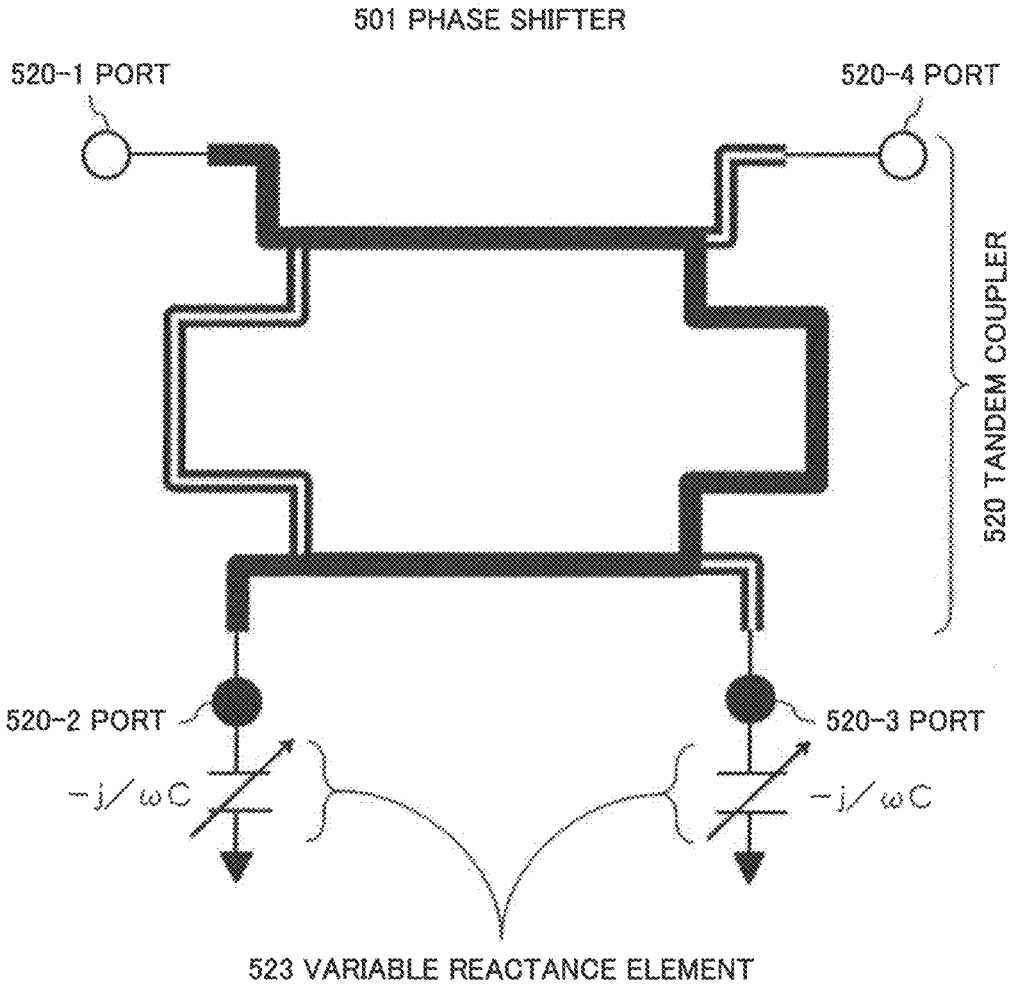
FIG. 15 is an enlarged diagram of a phase shifter used in the configuration of the variable directivity antenna device according to the third exemplary embodiment of the present invention.

FIG. 15 is an enlarged diagram illustrating a configuration of the phase shifter 501 illustrated in FIG. 14. The phase shifter 501 includes a tandem coupler 520 and variable reactance elements 523. The phase shifter 501 is able to control a phase by sweeping a capacitance value C of the variable reactance element 523, without varying a transmission coefficient between a port 520-1 and a port 520-4, in other words, with no loss.

The tandem coupler 520 is constituted of two transmission lines. The tandem coupler 520 is obtained by bringing the two transmission lines close to each other for a section equivalent to a length of ¼ wavelength, in such a manner that the two transmission lines are electromagnetically coupled to each other at two points. The tandem coupler 520 includes four in number of the port 520-1, a port 520-2, a port 520-3, and the port 520-4. The tandem coupler 520 is connected with the respective short-circuited variable reactance elements 523 at the port 520-2 and the port 520-3. Upon input of a signal to the port 520-1, the tandem coupler 520 outputs a signal from the port 520-4.

In the third exemplary embodiment of the present invention, a variable directivity antenna is constituted of only phase shifters, without using an antenna element. This realizes a smaller-sized antenna having a wider beam scan range. In addition, the tandem coupler 520 constituting a phase shifter operates as a hybrid coupler, similarly to the branch line coupler according to the first exemplary embodiment. In other words, since a phase is controlled by controlling a variable reactance element, a return loss per phase shifter can be minimized. Therefore, the variable directivity antenna device according to the present exemplary embodiment is able to perform beam scanning for a wide range.

[Fourth Exemplary Embodiment]

A fourth exemplary embodiment of a variable directivity antenna device according to the present invention will be described in detail with reference to the drawings.

Figure 16:
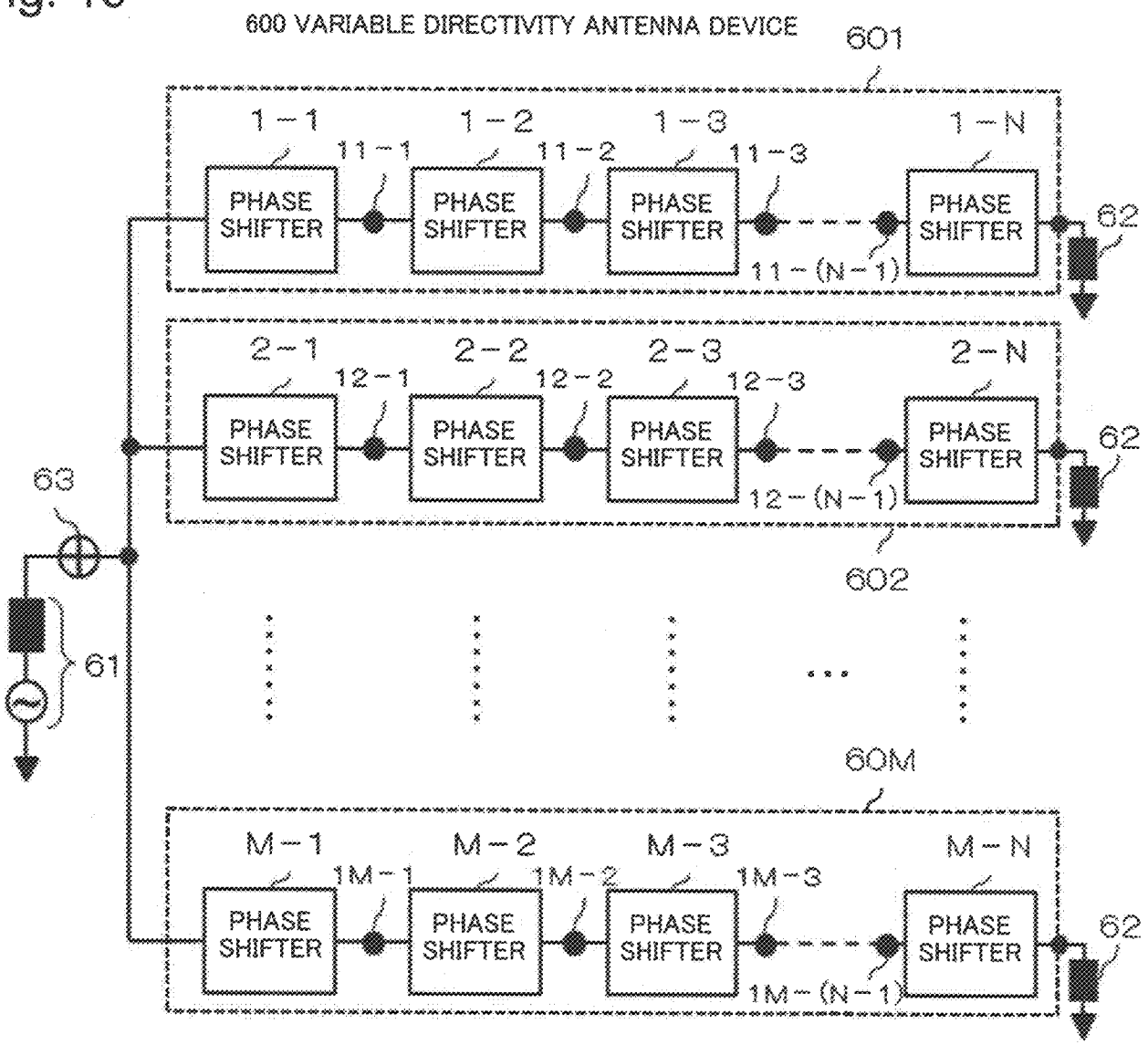
FIG. 16 is a block diagram illustrating a configuration of a variable directivity antenna device according to a fourth exemplary embodiment of the present invention.

First, with reference to FIG. 16, a configuration example of the fourth exemplary embodiment will be described. FIG. 16 is a block diagram illustrating a configuration example of a variable directivity antenna device 600 according to the fourth exemplary embodiment. The variable directivity antenna device 600 according to the fourth exemplary embodiment includes a first phase shifter group 601, a second phase shifter group 602, a third phase shifter group 603, . . . , an M-th phase shifter group 60M, a power feed part 61, terminating resistor parts 62, and a parallel connection part 63. Herein, the first phase shifter group 601 includes phase shifters 1-1, 1-2, 1-3, . . . , and 1-N, and connection parts 11-1, 11-2, 11-3, . . . , and 11-(N−1). Similarly, the second phase shifter group includes phase shifters 2-1, 2-2, 2-3, . . . , and 2-N, and connection parts 12-1, 12-2, 12-3, . . . , and 12-(N−1), . . . , and the M-th phase shifter group includes phase shifters M-1, M-2, M-3, . . . , and M-N, and connection parts 1M-1, 1M-2, 1M-3, . . . , and 1M-(N−1). The phase shifters 1-1, 1-2, . . . , and 1-N, the connection parts 11-1, 11-2, . . . , and 11-(N−1), the power feed part 61, and the terminating resistor parts 62 have functions being the same as those of the phase shifters 101, 102, 103, . . . , and 10N, the connection parts 111, 112, . . . , and 11(N−1), the power feed part 11, and the terminating resistor part 12 according to the first exemplary embodiment, respectively. Thus, detailed description therefor will be omitted. The variable directivity antenna device 600 according to the present exemplary embodiment is characterized by further including the parallel connection part 63 in order to array the arrangement structure (the first phase shifter group according to the present exemplary embodiment) of the phase shifters 101, 102, 103, . . . , and 10N according to the first exemplary embodiment described above.

The variable directivity antenna device 600 is an array structure in which two or more groups of the first phase shifter group 601 are connected in parallel. The second phase shifter group, the third phase shifter group, . . . , and the M-th phase shifter group are arranged at equal intervals in a direction (column direction) being different from an arrangement direction (row direction) of the first phase shifter group 601. Each of the second phase shifter group 602, the third phase shifter group 603, . . . , and the M-th phase shifter group 60M according to the present exemplary embodiment is constituted of the same phase shifter group (the phase shifters 1-1, 1-2, 1-3, . . . , and 1-N) as the first phase shifter group 601. However, each of the second phase shifter group 602, the third phase shifter group 603, . . . , and the M-th phase shifter group 60M may be constituted of a phase shifter group being different from the first phase shifter group 601. For example, a type, a number, an arrangement shape, and the like of phase shifters for use may be different for each phase shifter group. In addition, the first phase shifter group 601, the second phase shifter group 602, the third phase shifter group 603, . . . , and the M-th phase shifter group 60M according to the present exemplary embodiment may be arranged at mutually different intervals.

The parallel connection part 63 parallelly and electrically connects end portions of respective arrangement structures of the first phase shifter group 601, the second phase shifter group 602, the third phase shifter group 603, . . . , and M-th phase shifter group 60M on a side where the terminating resistor parts 62 are not connected. The parallel connection part 63 connects the first phase shifter group 601, the second phase shifter group 602, the third phase shifter group 603, . . . , and the M-th phase shifter group 60M respectively with the power feed part 61.

In the fourth exemplary embodiment of the present invention, a variable directivity antenna device having an arrayed arrangement structures of phase shifters is realized. An arrayed variable directivity antenna device has directivity also in an arrayed direction. Therefore, the variable directivity antenna device according to the present exemplary embodiment can have an enhanced antenna gain.

[Fifth Exemplary Embodiment]

A fifth exemplary embodiment of a variable directivity antenna device according to the present invention will be described in detail with reference to the drawings.

First, with reference to FIGS. 17A, 17B, and 17C, a configuration example of the fifth exemplary embodiment will be described.

Figure 17A:
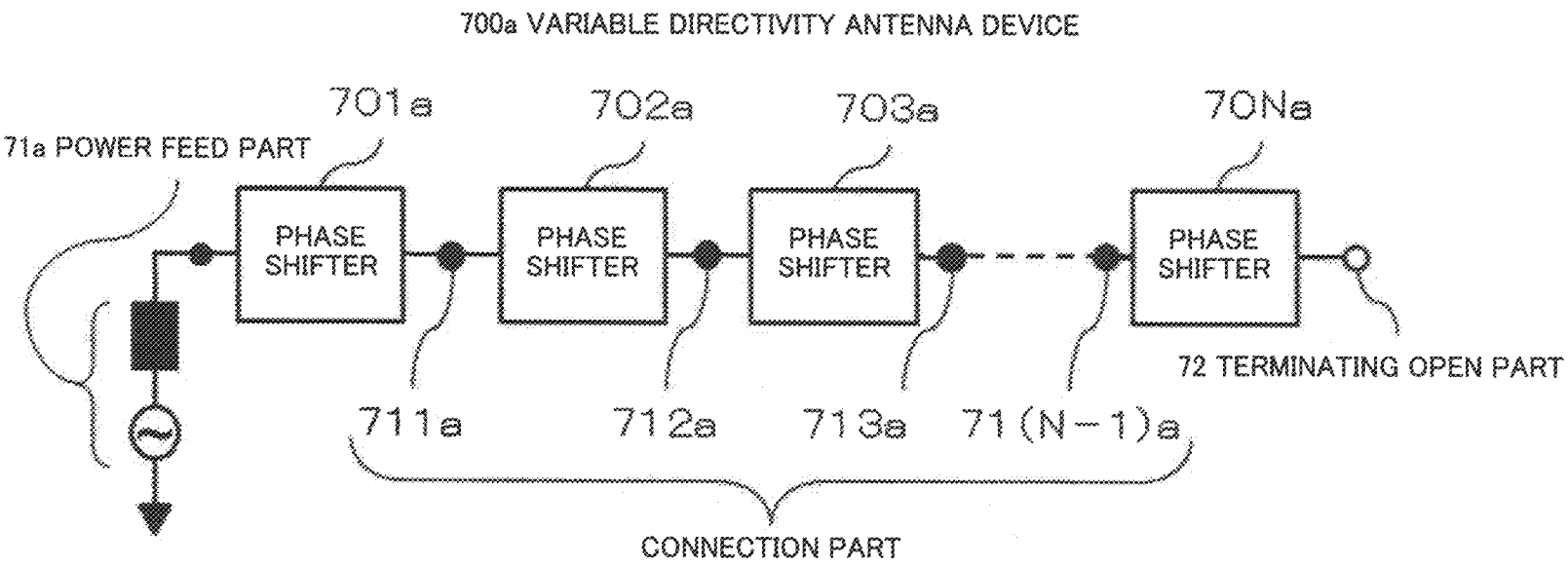
FIG. 17A is a block diagram illustrating a configuration of a variable directivity antenna device according to a fifth exemplary embodiment of the present invention.

FIG. 17A is a block diagram illustrating a configuration example of a variable directivity antenna device 700*a* according to the fifth exemplary embodiment. The variable directivity antenna device 700*a* according to the fifth exemplary embodiment includes phase shifters 701*a*, 702*a*, 703*a*, . . . , and 70Na, connection parts 711*a*, 712*a*, . . . , and 71(N−1)a, a power feed part 71*a*, and a terminating open part 72. The phase shifters 701*a*, 702*a*, 703*a*, . . . , and 70Na, the connection parts 711*a*, 712*a*, . . . , and 71(N−1)a, and the power feed part 71*a* have functions being the same as those of the phase shifters 101, 102, 103, . . . , and 10N, the connection parts 111, 112, . . . , and 11(N−1), and the power feed part 11 according to the first exemplary embodiment, respectively. Thus, detailed description therefor will be omitted.

Figure 17B:
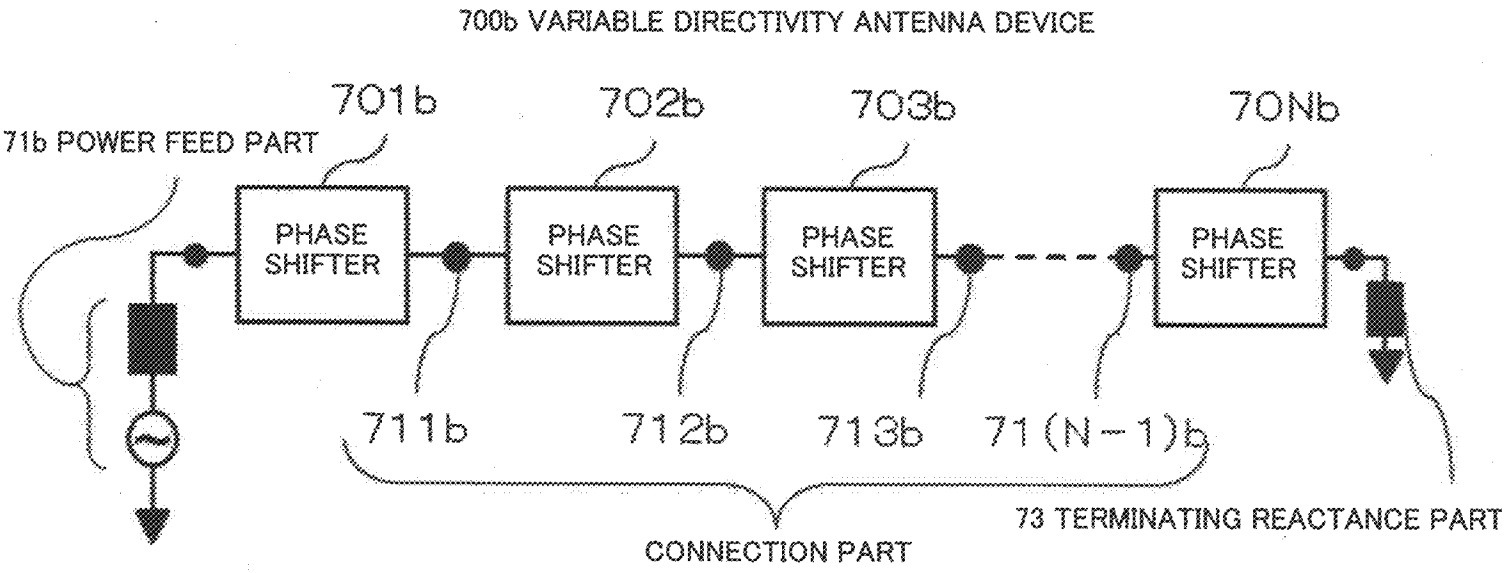
FIG. 17B is a block diagram illustrating a configuration of a variable directivity antenna device according to the fifth exemplary embodiment of the present invention.

Similarly, FIG. 17B is a block diagram illustrating a configuration example of a variable directivity antenna device 700*b* according to the fifth exemplary embodiment. The variable directivity antenna device 700*b* according to the fifth exemplary embodiment includes phase shifters 701*b*, 702*b*, 703*b*, . . . , and 70Nb, connection parts 711*b*, 712*b*, . . . , and 71(N−1)b, a power feed part 71*b*, and a terminating reactance part 73. The phase shifters 701*b*, 702*b*, 703*b*, . . . , and 70Nb, the connection parts 711*b*, 712*b*, . . . , and 71(N−1)b, and the power feed part 71*b* have functions being the same as those of the phase shifters 101, 102, 103, . . . , and 10N, the connection parts 111, 112, . . . , and 11(N−1), and the power feed part 11 according to the first exemplary embodiment, respectively. Thus, detailed description therefor will be omitted.

Figure 17C:
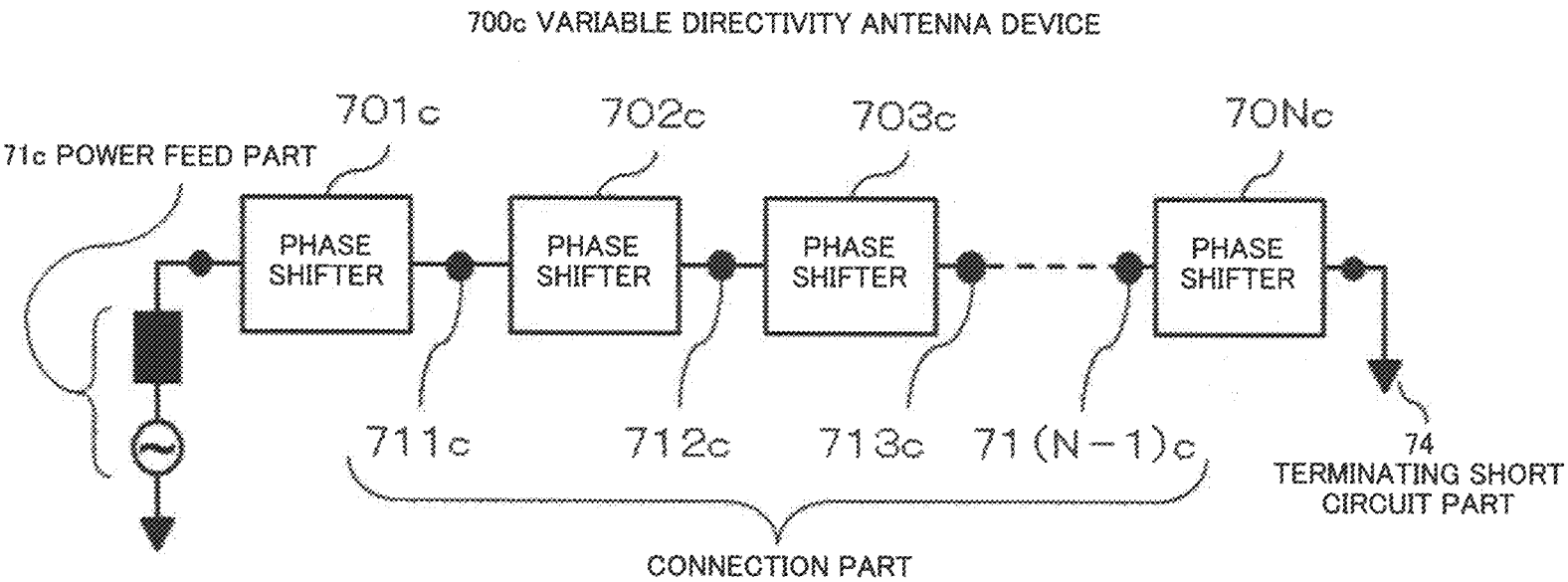
FIG. 17C is a block diagram illustrating a configuration of a variable directivity antenna device according to the fifth exemplary embodiment of the present invention.

Similarly, FIG. 17C is a block diagram illustrating a configuration example of a variable directivity antenna device 700*c* according to the fifth exemplary embodiment. The variable directivity antenna device 700*c* according to the fifth exemplary embodiment includes phase shifters 701*c*, 702*c*, 703*c*, . . . , and 70Nc, connection parts 711*c*, 712*c*, . . . , and 71(N−1)c, a power feed part 71*c*, and a terminating short circuit part 74. The phase shifters 701*c*, 702*c*, 703*c*, . . . , and 70Nc, the connection parts 711*c*, 712*c*, . . . , and 71(N−1)c, and the power feed part 71*c* have functions being the same as those of the phase shifters 101, 102, 103, . . . , and 10N, the connection parts 111, 112, . . . , and 11(N−1), and the power feed part 11 according to the first exemplary embodiment, respectively. Thus, detailed description therefor will be omitted.

The terminating open part 72, the terminating reactance part 73, or the terminating short circuit part 74 according to the present exemplary embodiment is a replaced configuration of the terminating resistor part 12 according to the first exemplary embodiment described above.

The terminating open part 72 is connected with an end portion (on a side opposite to the power feed part 71*a*) of an arrangement structure of the phase shifters 701*a*, 702*a*, 703*a*, . . . , and 70Na. The terminating open part 72 reflects a travelling wave supplied from the power feed part 71*a* and forms a reflected wave. This forms a standing wave, and thus, the variable directivity antenna device 700*a* operates as a resonant antenna. On the same principle, the terminating reactance part 73 and the terminating short circuit part 74 also cause the variable directivity antenna devices 700*b* and 700*c* to operate as resonant antennas.

In the fifth exemplary embodiment of the present invention, a variable directivity antenna device that operates as a resonant antenna is realized. By being realized as a resonant antenna, the variable directivity antenna device according to the present exemplary embodiment has an enhanced radiation efficiency.

[Sixth Exemplary Embodiment]

A sixth exemplary embodiment of a variable directivity antenna device according to the present invention will be described in detail with reference to the drawings.

Figure 18:
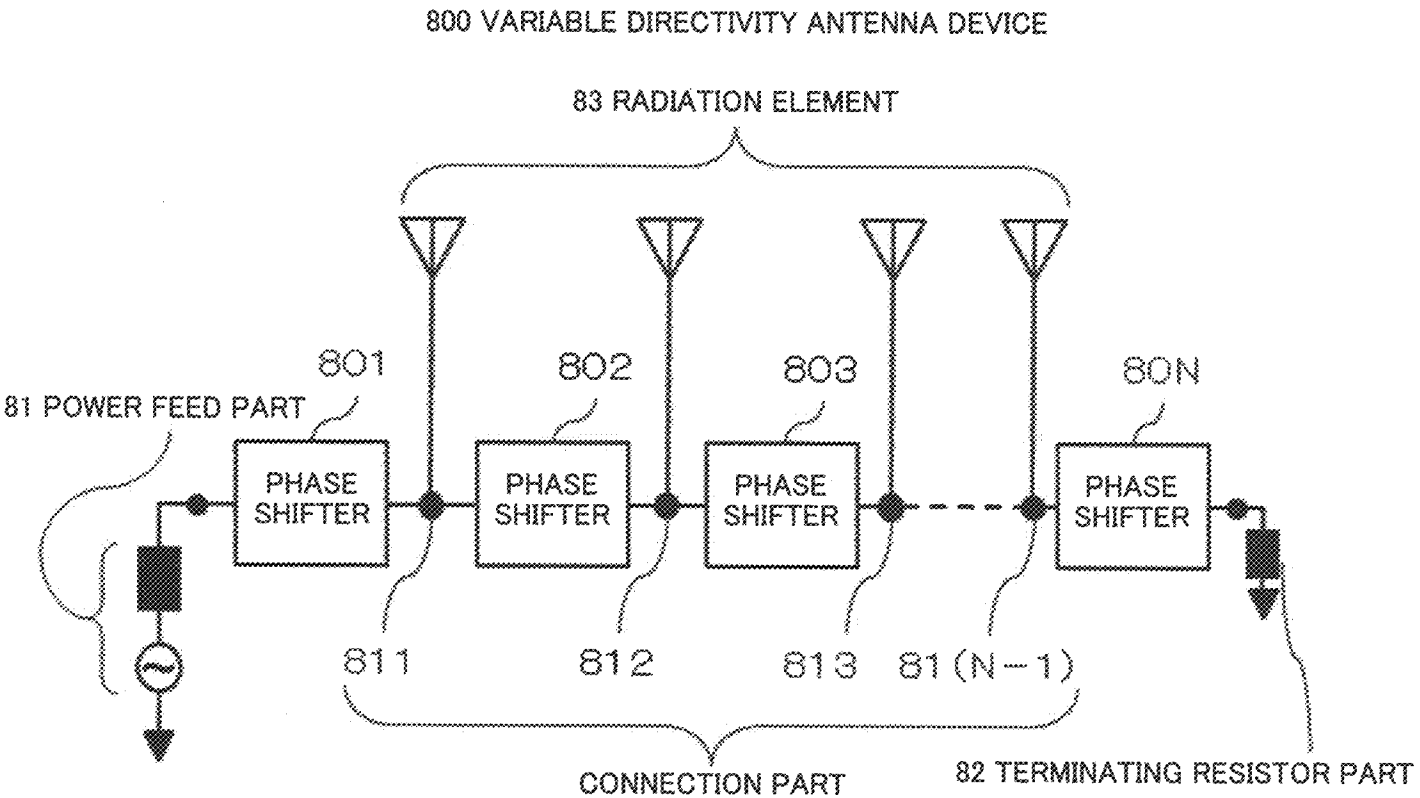
FIG. 18 is a block diagram illustrating a configuration of a variable directivity antenna device according to a sixth exemplary embodiment of the present invention.

First, with reference to FIG. 18, a configuration example according to the sixth exemplary embodiment will be described. FIG. 18 is a block diagram illustrating a configuration example of a variable directivity antenna device 800 according to the sixth exemplary embodiment. The variable directivity antenna device 800 according to the sixth exemplary embodiment includes phase shifters 801, 802, 803, . . . , and 80N, connection parts 811, 812, . . . , and 81(N−1), a power feed part 81, a terminating resistor part 82, and radiation elements 83. The phase shifters 801, 802, 803, . . . , and 80N, the connection parts 811, 812, . . . , and 81(N−1), the power feed part 81, and the terminating resistor part 82 has functions being the same as those of the phase shifters 101, 102, 103, . . . , and 10N, the connection parts 111, 112, . . . , and 11(N−1), the power feed part 11, and the terminating resistor part 12 according to the first exemplary embodiment, respectively. Thus, detailed description therefor will be omitted. The variable directivity antenna device 800 according to the present exemplary embodiment is characterized by further including the radiation elements 83, additionally to the variable directivity antenna device 100 according to the first exemplary embodiment described above.

The radiation elements 83 are electrically connected one-by-one with the connection parts 811, 812, . . . , and 81(N−1). The radiation elements 83 radiate radio waves emitted from the connection parts 811, 812, . . . , and 81(N−1). In the present exemplary embodiment, a plurality of radiation elements 83 are provided in the same number as that of the connection parts 811, 812, . . . , and 81(N−1). However, only one radiation element 83 may be provided, a plurality of radiation elements 83 may be provided, or radiation elements 83 less in number than that of the connection parts 811, 812, . . . , and 81(N−1) may be provided.

In the sixth exemplary embodiment according to the present invention, a variable directivity antenna device having enhanced radiation efficiency is realized.

[Seventh Exemplary Embodiment]

A seventh exemplary embodiment of a variable directivity antenna device according to the present invention will be described in detail with reference to the drawings.

Figure 19:
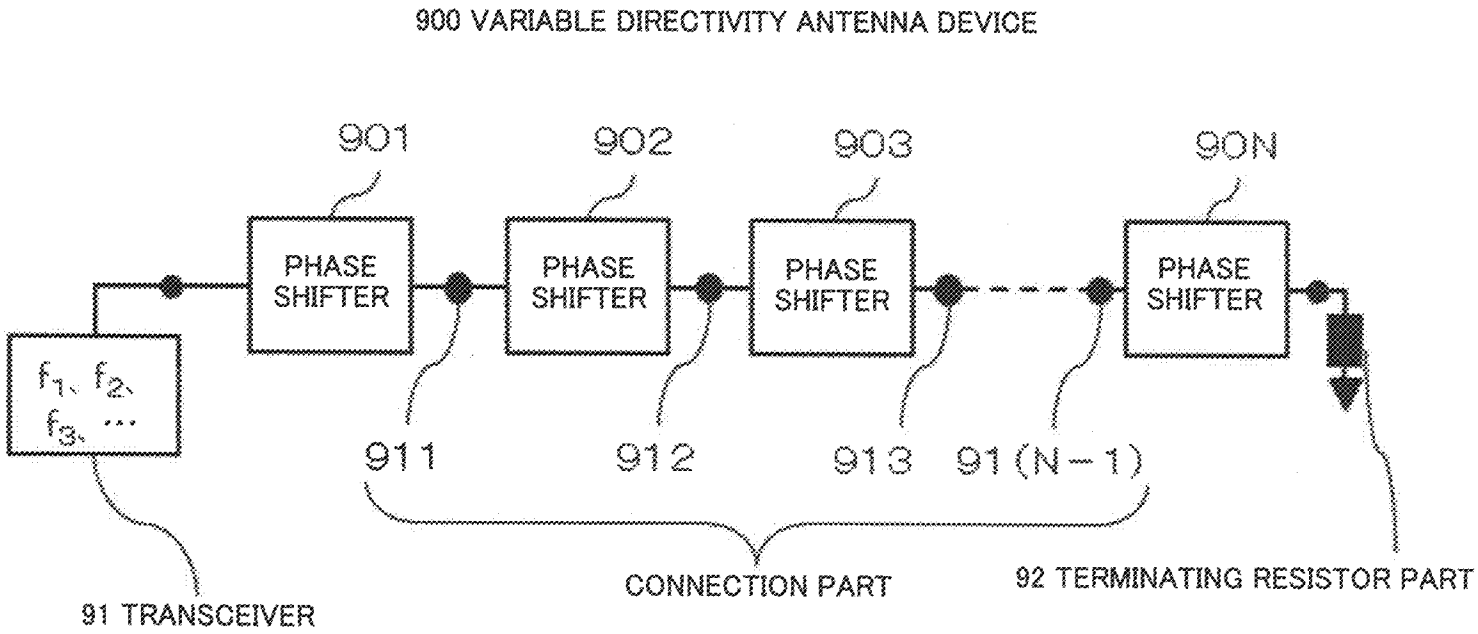
FIG. 19 is a block diagram illustrating a configuration of a variable directivity antenna device according to a seventh exemplary embodiment of the present invention.

First, with reference to FIG. 19, a configuration example of the seventh exemplary embodiment will be described. FIG. 19 is a block diagram illustrating a configuration example of a variable directivity antenna device 900 according to the seventh exemplary embodiment. The variable directivity antenna device 900 according to the seventh exemplary embodiment includes phase shifters 901, 902, 903, . . . , and 90N, connection parts 911, 912, . . . , and 91(N−1), a transceiver 91, and a terminating resistor part 92. The phase shifters 901, 902, 903, . . . , and 90N, the connection parts 911, 912, . . . , and 91(N−1), and the terminating resistor part 92 have functions being the same as those of the phase shifters 101, 102, 103, . . . , and 10N, the connection parts 111, 112, . . . , and 11(N−1), and the terminating resistor part 12 according to the first exemplary embodiment, respectively. Thus, detailed description therefor will be omitted. The transceiver 91 according to the present exemplary embodiment is a replaced configuration of the power feed part 11 according to the first exemplary embodiment described above.

The transceiver 91 is constituted of at least one of a frequency-variable transmitter and a frequency-variable receiver. A phase constant has dispersion with respect to frequency. Thus, the transceiver 91 is able to alter phases of the phase shifters 901, 902, 903, . . . , and 90N by varying frequencies. In other words, the variable directivity antenna device 900 is able to scan a beam by means of frequency control.

In the seventh exemplary embodiment of the present invention, a variable directivity antenna device that is able to scan a beam by controlling frequencies is realized.

[Eighth Exemplary Embodiment]

An eighth exemplary embodiment of a variable directivity antenna device according to the present invention will be described in detail with reference to the drawings.

Figure 20:
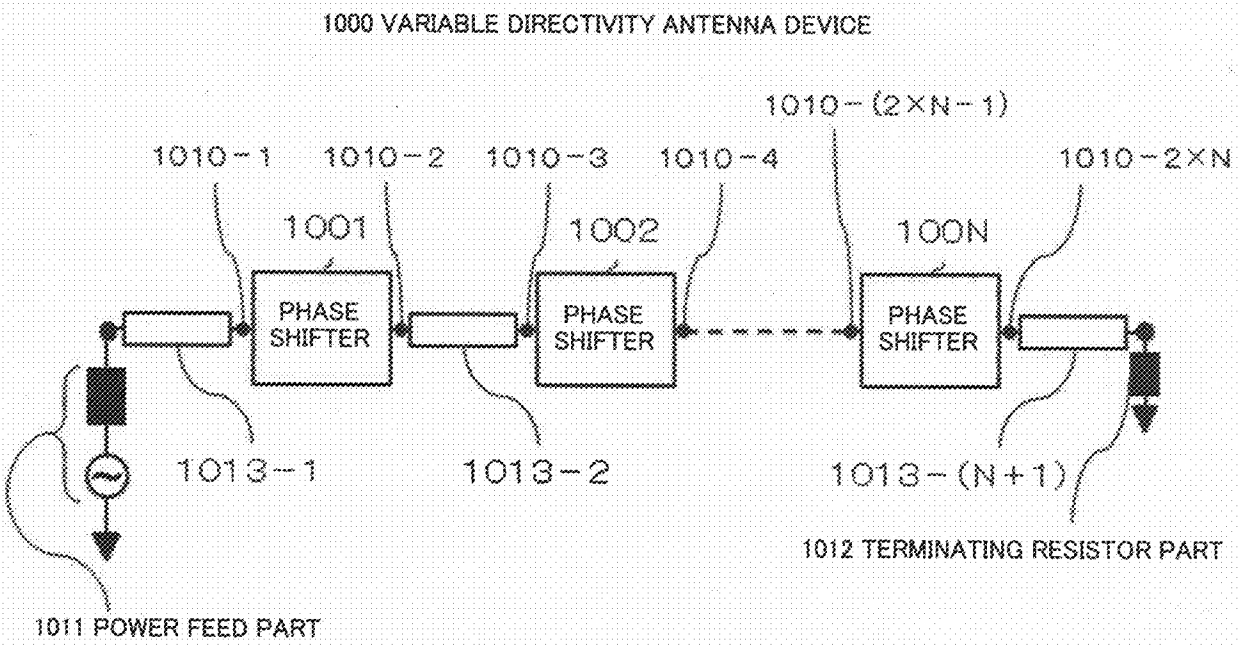
FIG. 20 is a block diagram illustrating a configuration of a variable directivity antenna device according to an eighth exemplary embodiment of the present invention.

First, with reference to FIG. 20, a configuration example according to the eighth exemplary embodiment will be described. FIG. 20 is a block diagram illustrating a configuration example of a variable directivity antenna device 1000 according to the eighth exemplary embodiment. The variable directivity antenna device 1000 according to the eighth exemplary embodiment includes phase shifters 1001, 1002, 1003, . . . , and 100N, transmission line connection parts 1010-1, 1010-2, 1010-3, . . . , and 1010-2×N, a power feed part 1011, a terminating resistor part 1012, and transmission lines 1013-1, 1013-2, 1013-3, . . . , and 1013-(N+1). The phase shifters 1001, 1002, 1003, . . . , and 100N, the power feed part 1011, and the terminating resistor part 1012 have functions being the same as those of the phase shifters 101, 102, 103, . . . , and 10N, the power feed part 11, and the terminating resistor part 12 according to the first exemplary embodiment, respectively. Thus, detailed description therefor will be omitted. The variable directivity antenna device 1000 according to the present exemplary embodiment is characterized by further including the transmission lines 1013-1, 1013-2, 1013-3, . . . , and 1013-(N+1) and the transmission line connection parts 1010-1, 1010-2, 1010-3, . . . , and 1010-2×N, additionally to the variable directivity antenna device 100 according to the first exemplary embodiment described above.

The transmission lines 1013-1, 1013-2, 1013-3, . . . , and 1013-(N+1) are electrically connected, by means of the transmission line connection parts 1010-1, 1010-2, 1010-3, . . . , and 1010-2×N, with the phase shifters 1001, 1002, 1003, . . . , and 100N in series directly without interposing another configuration. In the present exemplary embodiment, the transmission line 1013-1 has one end thereof connected with the phase shifter 1001 by means of the transmission line connection part 1010-1. The transmission line 1013-2 has one end thereof connected with another end (an end portion on a side where the transmission line 1013-1 is not connected) of the phase shifter 1001 by means of the transmission line connection part 1010-2. In addition, the transmission line 1013-2 has another end thereof (an end portion on a side where the phase shifter 1001 is not connected) connected with the phase shifter 1002 by means of the transmission line connection part 1010-3. Similarly, the transmission line 1013-3 has one end connected with the phase shifter 1002 by means of the transmission line connection part 1010-4, and another end connected with the phase shifter 1003 by means of the transmission line connection part 1010-5, . . . , and the transmission line 1013-(N+1) has one end connected with the phase shifter 100N by means of the transmission line connection part 1010-2×N.

Note that another end (an end portion on a side where the phase shifter 1001 is not connected) of the transmission line 1013-1 is connected with the power feed part 1011. In addition, another end (an end portion on a side where the phase shifter 100N is not connected) of the transmission line 1013-(N+1) is connected with the terminating resistor part 1012.

The transmission lines 1013-1, 1013-2, 1013-3, . . . , and 1013-(N+1) control phase delay amounts of the respective phase shifters 1001, 1002, 1003, . . . , and 100N by varying lengths and widths thereof. This control on the phase delay amounts shifts operating frequencies of the respective phase shifters 1001, 1002, 1003, . . . , and 100N. Since characteristic impedance is discontinuous between the transmission lines 1013-1, 1013-2, 1013-3, . . . , and 1013-(N+1) and the phase shifters 1001, 1002, 1003, . . . , and 100N respectively connected thereto, the transmission line connection parts 1010-1, 1010-2, 1010-3, . . . , and 1010-2×N, which are respective connection points, emit radio waves. Note that, for operation at high frequencies, not only the transmission line connection parts 1010-1, 1010-2, 1010-3, . . . , and 1010-2×N, but also the transmission lines 1013-1, 1013-2, 1013-3, . . . , and 1013-(N+1), emit radio waves.

In the present exemplary embodiment, the phase shifters 1001, 1002, 1003, . . . , and 100N and the transmission lines 1013-1, 1013-2, 1013-3, . . . , and 1013-(N+1) are arranged alternately and linearly. However, phase shifters may include a part having no transmission line interposed therebetween, as in the first exemplary embodiment, or phase shifters and transmission lines may be arranged non-linearly.

In the eighth exemplary embodiment according to the present invention, a variable directivity antenna device is realized that is able to control a phase delay amount and is able to readily shift an operating frequency of a phase shifter, by varying a length and a width of a transmission line.

In the above, the present invention has been described with reference to the exemplary embodiments and the specific examples. However, the present invention is not limited to the above-described exemplary embodiments. Various modifications that can be understood by those skilled in the art can be made to the configurations and details of the present invention within the scope of the present invention.

A part or all of the above-described exemplary embodiments can be described as the following Supplementary notes, but is not limited to the following.

(Supplementary Note 1)

An antenna device comprising:

a first phase shifter, a second phase shifter, and a third phase shifter;

a first connection part that electrically connects between the first phase shifter and the second phase shifter directly in series;

a second connection part that electrically connects between the second phase shifter and the third phase shifter directly in series; and a power feed part that feeds electric power to the first phase shifter to the third phase shifter, wherein the first phase shifter and the second phase shifter, and the second phase shifter and the third phase shifter respectively have characteristic impedance being discontinuous with respect to each other at the first connection part and the second connection part.

(Supplementary Note 2)

The antenna device according to Supplementary note 1, wherein a total phase delay of the first phase shifter to the third phase shifter is an integral multiple of a value twice a circumference ratio at a predetermined frequency.

(Supplementary Note 3)

The antenna device according to Supplementary note 1, wherein the first phase shifter to the third phase shifter have an attenuation constant of substantially zero at a predetermined frequency.

(Supplementary Note 4)

The antenna device according to Supplementary note 1, further comprising a control line for sending a control signal necessary for the first phase shifter to the third phase shifter to control each phase.

(Supplementary Note 5)

The antenna device according to Supplementary note 1, wherein the first phase shifter to the third phase shifter are arranged linearly.

(Supplementary Note 6)

The antenna device according to Supplementary note 1, further comprising one or a plurality of radiation elements, wherein the one radiation element is connected with the one connection part.

(Supplementary Note 7)

An antenna device comprising:

a first phase shifter, a second phase shifter, and a third phase shifter; and a transmission line, wherein each of the first phase shifter to the third phase shifter includes a hybrid coupler having a first port, a second port, a third port, and a fourth port, and two variable reactance elements capable of controlling a reactance value, the transmission line electrically connects between the fourth port of the first phase shifter and the first port of the second phase shifter, and between the fourth port of the second phase shifter and the first port of the third phase shifter directly in series, and the first phase shifter and the transmission line, the second phase shifter and the transmission line, and the third phase shifter and the phase shifter have characteristic impedance being discontinuous with respect to each other.

(Supplementary Note 8)

An antenna device comprising:

a first phase shifter, a second phase shifter, and a third phase shifter;

a first connection part that electrically connects between the first phase shifter and the second phase shifter directly in series;

a second connection part that electrically connects between the second phase shifter and the third phase shifter directly in series; and a power feed part that feeds electric power to the first phase shifter to the third phase shifter, wherein the first connection part and the second connection part emit a radio wave, and the first phase shifter to the third phase shifter control a direction of the radio wave by controlling a corresponding phase, and scan a radiation beam.

This application is based upon and claims the benefit of priority from Japanese Patent Application No. 2014-260897, filed on Dec. 24, 2014, the disclosure of which is incorporated herein in its entirety.

INDUSTRIAL APPLICABILITY

Application examples of the present invention include a variable directivity antenna device, particularly, an antenna device for mobile communication.

REFERENCE SIGNS LIST

100, 200, . . . , 600 Variable directivity antenna device
101, 102, . . . , 10N Phase shifter
111, 112, . . . , 11(N−1) Connection part
11, 21, . . . , 61 Power feed part
12, 22, . . . , 62 Terminating resistor part
13, 23, 33, 43, 53 Unit cell
14 Control line
201, 202, . . . , 20N Phase shifter
211, 212, . . . , 21(N−1) Connection part
220, 230 Hybrid coupler
221, 231 Main line
222, 232 Sub line
223, 233 Variable reactance element
220-1, 220-2, 220-3, 220-4 Port
230-1, 230-2, 230-3, 230-4 Port
301, 302 Phase shifter
320, 330 Hybrid coupler
321, 331 Main line
322, 332 Sub line
323, 333 Variable reactance element
320-1, 320-2, 320-3, 320-4 Port
330-1, 330-2, 330-3, 330-4 Port
311 Connection part
401, 402, . . . , 40N Phase shifter
411, 412, . . . , 41(N−1) Connection part
420 Lange coupler
421 Main line
422 Line
420-1, 420-2, 420-3, 420-4 Port
423 Variable reactance element

501, 502, . . . , 50N Phase shifter
511, 512, . . . , 51(N−1) Connection part
520 Tandem coupler
520-1, 520-2, 520-3, 520-4 Port
523 Variable reactance element
601, 602, . . . , 60M Phase shifter group
1-1, 1-2, . . . , 1-N Phase shifter
2-1, 2-2, . . . , 2-N Phase shifter
M-1, M-2, . . . , M-N Phase shifter
11-1, 11-2, . . . , 11-(N−1) Connection part
12-1, 12-2, . . . , 12-(N−1) Connection part
1M-1, 1M-2, . . . , 1M-(N−1) Connection part
63 Parallel connection part
700*a*, 700*b*, 700*c* Variable directivity antenna device
701*a*, 702*a*, . . . , 70Na Phase shifter
711*a*, 712*a*, . . . , 71(N−1)a Connection part
701*b*, 702*b*, . . . , 70Nb Phase shifter
711*b*, 712*b*, . . . , 71(N−1)b Connection part
701*c*, 702*c*, . . . , 70Nc Phase shifter
711*c*, 712*c*, . . . , 71(N−1)c Connection part
71*a*, 71*b*, 71*c* Power feed part
72 Terminating open part
73 Terminating reactance part
74 Terminating short circuit part
800, 900, 1000 Variable directivity antenna device
801, 802, . . . , 80N Phase shifter
811, 812, . . . , 81(N−1) Connection part
81, 1011 Power feed part
82, 92, 1012 Terminating resistor part
83 Radiation element
901, 902, . . . , 90N Phase shifter
911, 912, . . . , 91(N−1) Connection part
91 Transceiver
1001, 1002, . . . , 100N Phase shifter
1010-1, 1010-2, . . . , 1010-2×N Transmission line connection part
1013-1, 1013-2, . . . , 1013-(N+1) Transmission line

The invention claimed is:

1. An antenna device comprising:
a first phase shifter, a second phase shifter, and a third phase shifter;
a first connection part that electrically connects between the first phase shifter and the second phase shifter directly in series;
a second connection part that electrically connects between the second phase shifter and the third phase shifter directly in series; and
a power feed part that feeds electric power to the first phase shifter to the third phase shifter,
wherein the first phase shifter and the second phase shifter, and the second phase shifter and the third phase shifter respectively have characteristic impedance being discontinuous with respect to each other at the first connection part and the second connection part.

2. The antenna device according to claim 1,
wherein the antenna device emits a beam, and
the first phase shifter to the third phase shifter scan the beam by controlling a corresponding phase.

3. The antenna device according to claim 1,
wherein the antenna device is configured by causing the first phase shifter and the second phase shifter, or the first phase shifter to the third phase shifter, to serve as a unit cell, and repeatedly arranging the unit cell, and the unit cell each has a periodic phase delay.

4. The antenna device according to claim 1,
wherein each of the first phase shifter to the third phase shifter includes a hybrid coupler having a first port, a second port, a third port, and a fourth port, and two variable reactance elements capable of controlling a reactance value,
one ends of the two variable reactance elements are connected one-by-one with the second port and the third port, and
another ends of the two variable reactance elements are short-circuited.

5. The antenna device according to claim 4, wherein the antenna device scans the beam by controlling a capacitance value of the variable reactance element.

6. The antenna device according to claim 4,
wherein the hybrid coupler includes a main line and a sub line having a characteristic impedance being different from each other,
the connection part connects the main line of the hybrid coupler with the main line of the hybrid coupler, and
the characteristic impedance of the main line is different between the first phase shifter and the second phase shifter, and between the second phase shifter and the third phase shifter.

7. The antenna device according to claim 1,
wherein the first phase shifter to the third phase shifter have an arrangement structure in which a terminating part is connected with a resistor or a reactance, or is open or short-circuited.

8. The antenna device according to claim 1,
wherein both or either one of a total length of the first phase shifter and the second phase shifter and a total length of the second phase shifter and the third phase shifter is shorter than a length half a free space wavelength at a predetermined frequency.

9. The antenna device according to claim 1, further comprising two or more groups of arrangement structures of the first phase shifter to the third phase shifter, and a parallel connection part,
wherein the parallel connection part parallelly connects respective one ends of the two or more groups of the arrangement structures, and
the power feed part feeds electric power to the two or more groups of the arrangement structures.

10. The antenna device according to claim 1,
wherein a total phase delay of the first phase shifter to the third phase shifter is an integral multiple of a value twice a circumference ratio at a predetermined frequency.

11. The antenna device according to claim 1,
wherein the first phase shifter to the third phase shifter have an attenuation constant of substantially zero at a predetermined frequency.

12. The antenna device according to claim 1, further comprising a control line for sending a control signal necessary for the first phase shifter to the third phase shifter to control each phase.

13. The antenna device according to claim 1,
wherein the first phase shifter to the third phase shifter are arranged linearly.

14. The antenna device according to claim 1, further comprising one or a plurality of radiation elements, wherein the one radiation element is connected with the one connection part.

15. An antenna device comprising:
a first phase shifter, a second phase shifter, and a third phase shifter;
a first connection part that electrically connects between the first phase shifter and the second phase shifter directly in series;

a second connection part that electrically connects between the second phase shifter and the third phase shifter directly in series; and a transceiver that performs both or either one of transmission and reception of a frequency-variable signal to the first phase shifter to the third phase shifter, wherein the first phase shifter and the second phase shifter, and the second phase shifter and the third phase shifter respectively have characteristic impedance being discontinuous with respect to each other at the first connection part and the second connection part, and the transceiver scans a radiation beam by controlling a frequency.

16. An antenna device comprising:

a first phase shifter, a second phase shifter, and a third phase shifter; and a transmission line, wherein each of the first phase shifter to the third phase shifter includes a hybrid coupler having a first port, a second port, a third port, and a fourth port, and two variable reactance elements capable of controlling a reactance value, the transmission line electrically connects between the fourth port of the first phase shifter and the first port of the second phase shifter, and between the fourth port of the second phase shifter and the first port of the third phase shifter directly in series, and the first phase shifter and the transmission line, the second phase shifter and the transmission line, and the third phase shifter and the phase shifter have characteristic impedance being discontinuous with respect to each other.

* * * * *